US008770401B2

(12) United States Patent
Fitchett

(10) Patent No.: US 8,770,401 B2
(45) Date of Patent: Jul. 8, 2014

(54) OPEN PACKAGING

(75) Inventor: Derek A. Fitchett, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 166 days.

(21) Appl. No.: 12/847,273

(22) Filed: Jul. 30, 2010

(65) Prior Publication Data

US 2012/0024731 A1 Feb. 2, 2012

(51) Int. Cl.
*B65D 85/00* (2006.01)
*B65D 25/54* (2006.01)

(52) U.S. Cl.
USPC ..... 206/315.9; 206/779; 206/780; 229/162.1

(58) Field of Classification Search
USPC ..... 206/315.9, 763, 780, 485, 756, 779, 206/486; 229/162.1
See application file for complete search history.

(56) References Cited

U.S. PATENT DOCUMENTS

| | | | | |
|---|---|---|---|---|
| 3,017,018 | A * | 1/1962 | Price | 206/763 |
| 4,778,179 | A * | 10/1988 | Balaz | 206/315.9 |
| 5,183,154 | A * | 2/1993 | Slemp | 206/315.9 |
| 5,195,633 | A * | 3/1993 | Kaminski | 206/315.9 |
| 6,290,062 | B2 * | 9/2001 | Ohno et al. | 206/459.5 |
| 2003/0121809 | A1 | 7/2003 | Gourd et al. | |
| 2009/0277940 | A1 | 11/2009 | Cook | |

FOREIGN PATENT DOCUMENTS

| | | |
|---|---|---|
| CN | ZL201120271894.X | 7/2012 |
| GB | 731233 | 6/1955 |
| JP | 49-105263 | 9/1974 |
| JP | 3036728 | 5/1997 |

OTHER PUBLICATIONS

Extended European Search Report dated Oct. 26, 2011 in European Patent Application No. EP 11 17 5974.
Office Action for Chinese Invention Patent Application No. 201110213645.X, mailed on Dec. 24, 2012.
Notice of Allowance for Chinese Utility Model Patent Application No. 201120271894.X, mailed on Mar. 19, 2012.
Communication pursuant to Rules 70(2) and 70a(2) EPC and reference to Rule 39(1) EPC for European Patent Application No. 11175974.2, mailed on Feb. 6, 2012.
Response to Communication pursuant to Rules 70(2) and 70a(2) EPC and reference to Rule 39(1) EPC for European Patent Application No. 11175974.2 as filed on Jul. 24, 2012.
Communication pursuant to Article 94(3) EPC for European Patent Application No. 11175974.2, mailed on Aug. 16, 2012.
Response to Communication pursuant to Article 94(3) EPC for European Patent Application No. 11175974.2, as filed on Dec. 21, 2012.
Final Office Action for Japanese Patent Application 2011-159522, issued Mar. 4, 2014.

* cited by examiner

*Primary Examiner* — Mickey Yu
*Assistant Examiner* — Chun Cheung
(74) *Attorney, Agent, or Firm* — Plumsea Law Group, LLC

(57) ABSTRACT

A packaging for at least one ball includes at least one opening that is configured to expose a portion of the ball. The openings are configured to restrict movement of the ball by engaging a surface of the ball. This packaging reduces the amount of the packaging material needed to produce the packaging while maximizing the amount of shelf space needed to display the packaging to increase visibility of the packaging.

11 Claims, 29 Drawing Sheets

OPEN PACKAGING

BACKGROUND

The present disclosure relates generally to a packaging for balls. More particularly, the present disclosure relates generally to an open packaging for sporting balls.

Recently, there has been an effort to produce packaging that lessens the environmental impact. One way is to make the packaging of a recyclable, degradable, post-consumer and/or biodegradable material. An alternative and additional way is to minimize the amount of packaging material used by removing or reducing any unnecessary packaging. However, minimizing the amount of packaging material could impact the display and placement of the product in retailers.

The display and placement of the product on the shelves of retailers can help persuade a consumer to purchase a product. For example, the amount of shelf space allocated to the product and the location of the shelf space can influence the sales of the product. The more favorable shelf space generally is the shelf area that is more visible to a consumer, for example, the shelf space at eye level and/or a large allocation of shelf space. However, there is competition for favorable shelf space. Retailers generally have more products available to be displayed than they have shelf space. Also, retailers may want to have as much product as possible in a given area so that the risk of the unavailability of a product on the shelf is minimized. Retailers may also want to avoid having unnecessarily long periods where the product is unavailable on the shelf because the original displayed quantity of sold products has been sold.

Retailers typically maximize the shelf space available by the placement of the products on a shelf. Retailers generally display products on a shelf by stacking the additional products behind and/or on top of the first visible product on the shelf. A manufacturer can improve the chances of a more favorable shelf space placement of the product by using a packaging that requires more visible shelf space, such as horizontal space, to display the first visible product.

Additional considerations in the design of the packaging include shipping and handling. The packaging should provide protection against blemishes during shipping and handling. Also, the packaging should not be subject to movement or rolling when placed in a shipping box or displayed on a shelf.

One of the more difficult items to package and display are round or spherical objects, such as balls. Golf balls are mostly sold by the dozen in a solid rectangular or square outer box packaging. Many of the outer box packaging further includes four solid inner rectangular boxes called "sleeves" that each contain three golf balls.

Therefore, there exists a need in the art for packaging for balls that lessens the environmental impact by reducing the amount of packaging material, while maximizing the visibility of the packaging on a shelf.

SUMMARY

An open packaging includes features that minimize the amount of packaging material required to contain and that are configured to stabilize the balls while shipping and handling. These features are configured to maximize the amount of shelf space required for the packaging to be displayed on a retail shelf.

In one aspect, a packaging is provided for at least one ball. The packaging comprises a first wall and a second wall opposing the first wall, the first wall and the second wall each including at least one opening. The packaging also comprises at least one wall opening being between the first wall and the second wall. The opening is configured to expose a portion of the ball and restrain movement of the ball, and the wall opening is configured to expose a portion of the ball.

In another aspect, the first wall and the second wall each include three circular openings, the openings of the first wall and the second wall being identical.

In another aspect, the packaging is configured to contain three golf balls.

In another aspect, the first wall and the second wall each include four cylindrical openings, the openings of the first wall and the second wall being identical.

In another aspect, the packaging is configured to contain twelve balls.

In another aspect, the packaging is configured to receive at least one of a second packaging, each second packaging being configured to contain three balls.

In another aspect, a packaging is provided for at least two balls. The package comprises a first column and a second column adjacent to the first column in a first direction. The first column and the second column are each configured to contain a ball and having at least one opening configured to expose a portion of the ball and restrain movement of the ball. The first column is disposed at a first position and the second column is disposed at a second position with respect to a second direction that is perpendicular to the first direction, the first position being different than the second position.

In another aspect, the packaging further comprises a third column adjacent to the second column in the first direction and a fourth column adjacent to the third column in the first direction. The third column and the fourth column are each configured to contain the ball and each having the opening configured to expose a portion of the ball and restrain movement of the ball. The third column is disposed at the first position and the fourth column is disposed at the second position.

In another aspect, the packaging further comprises a third column and a fourth column adjacent to the third column in the first direction. The third column and the fourth column are each configured to contain the ball and having the opening configured to expose a portion of the ball and restrain movement of the ball. The third column is disposed at the second position and the fourth column is disposed at the first position.

In another aspect, a one-piece blank for forming a packaging for containing at least one ball is provided. The blank comprises a front panel that forms a front of a packaging; and a back panel that is identical to the front panel and that forms the back of the packaging. The front and back panels each include at least one opening to expose the ball. The blank also comprises a first side panel that is between the front panel and back panel and that is hingedly connected to the front panel and the back panel and a second side panel that is adjacent to and is hingedly connected to one of a front panel and a back panel.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
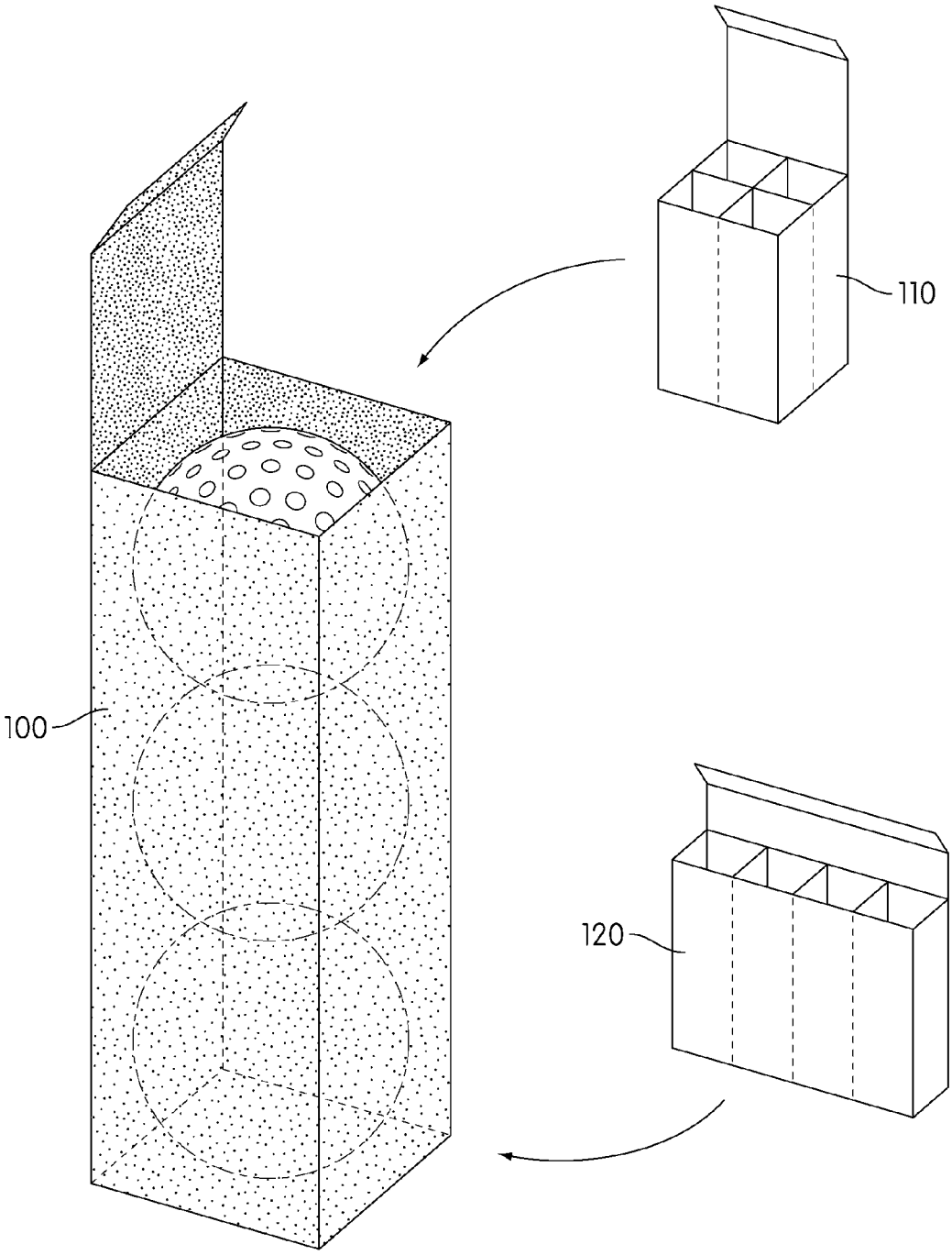
FIG. 1 PRIOR ART
FIG. 1 is a schematic perspective view of known packagings for golf balls.

Golf balls are typically sold in a package of twelve balls. A package of twelve balls typically includes four sleeves 100 of three golf balls. Such a sleeve 100 is shown in FIG. 1. Sleeve 100 is generally provided in a rectangular box. FIG. 1 also shows two known solid outer boxes 110 and 120 that are configured to contain four sleeves 100. Square outer box 110 contains two adjacent rows of two sleeves 100. Rectangular outer box 120 contains four sleeves 100 side-by-side. Sleeves 100 and outer boxes 110 and 120 also require packaging material for all sides. Sleeves 100 and outer boxes 110 and 120 are typically made of a paper product, such as cardboard with a resin layer, recyclable material, recycled material and/or post-consumer material.

Figure 2:
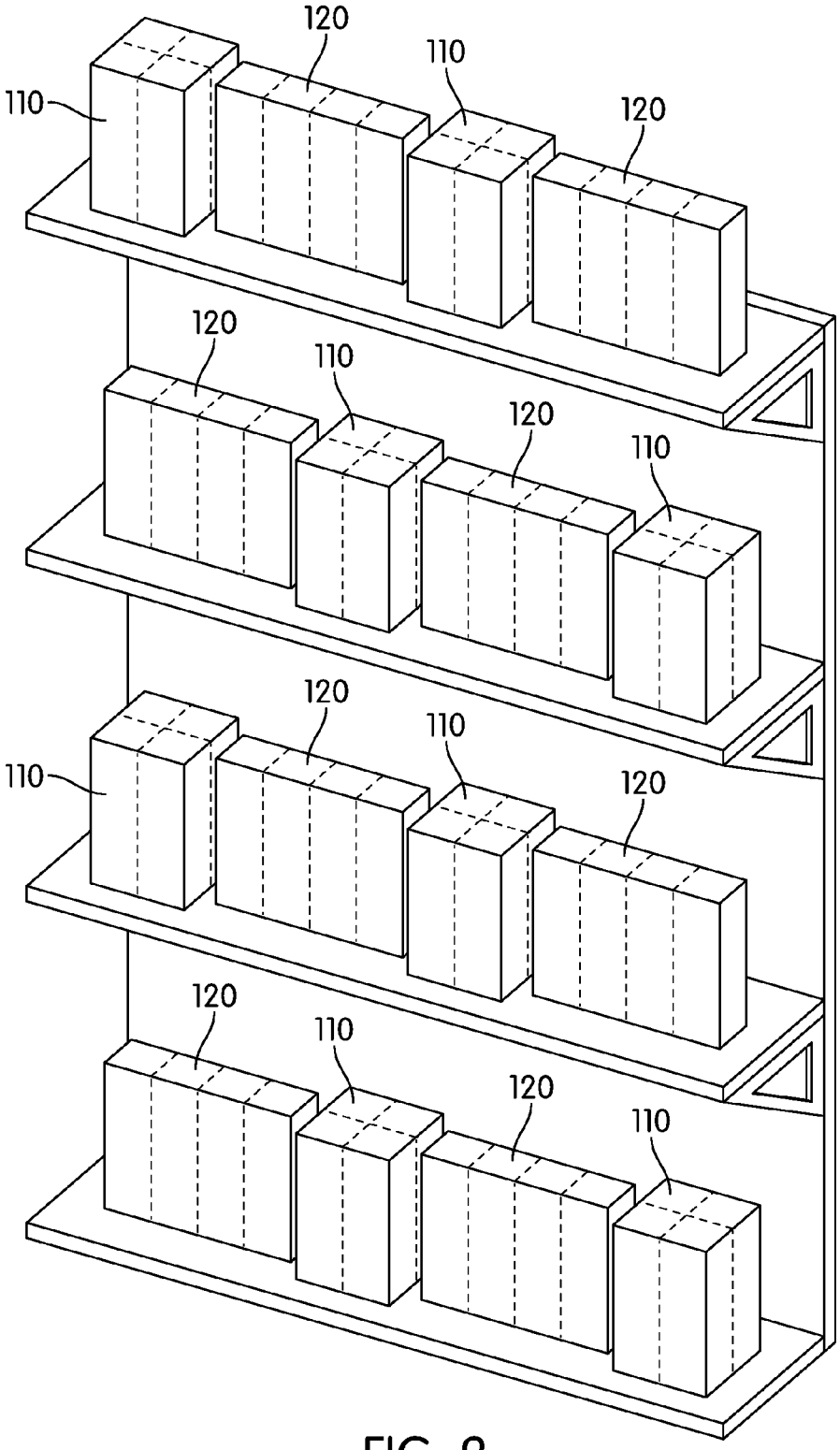
FIG. 2 PRIOR ART
FIG. 2 is a schematic front view of retailer shelves displaying the known packagings.

FIG. 2 shows a typical example of a retail shelf display of outer boxes 110 and 120. In FIG. 2, each individual outer box 110 and 120 corresponds to a different product. Rectangular outer box 120 has a larger diameter than square outer box 110 and thus requires more shelf space than square outer box 110. Retailers place the extra products behind the first visible product. Retailers thus generally allocate more visible space to rectangular outer box 120 than square outer box 110. Accordingly, rectangular outer box 120 has a more favorable shelf placement than square outer box 110.

The present embodiments relate to an open packaging for a round object. The round object may be any type of round object. For example, the round object may be tennis balls, table tennis balls and any other type of athletic ball. The discussion herein is generally limited to a discussion of an open packaging for a golf ball, but the round object should not be considered to be so limited.

The embodiments of the opening packaging described herein are designed to reduce the amount of packaging material, and, in some embodiments, reducing the packaging material without necessarily reducing the amount of shelf space for displaying the packaging. Instead, many of the embodiments of the open packaging are designed to enhance the visibility of the product by encouraging favorable retail shelf placement. As shown in the figures, the amount of packaging material may be reduced by adding openings in the opposing walls. These openings provide additional support and containment for the ball. These openings also further reduce the amount of packaging material by reducing the packaging material needed to contain a golf ball. Because the openings expose portions of the ball, the packaging may have a configuration in which the depth is less than the diameter of a golf ball. Also, due to the additional support of these openings, opposing walls may be removed and thus further reducing the amount of packaging material needed to manufacture the packaging according to the embodiments.

Figure 3:
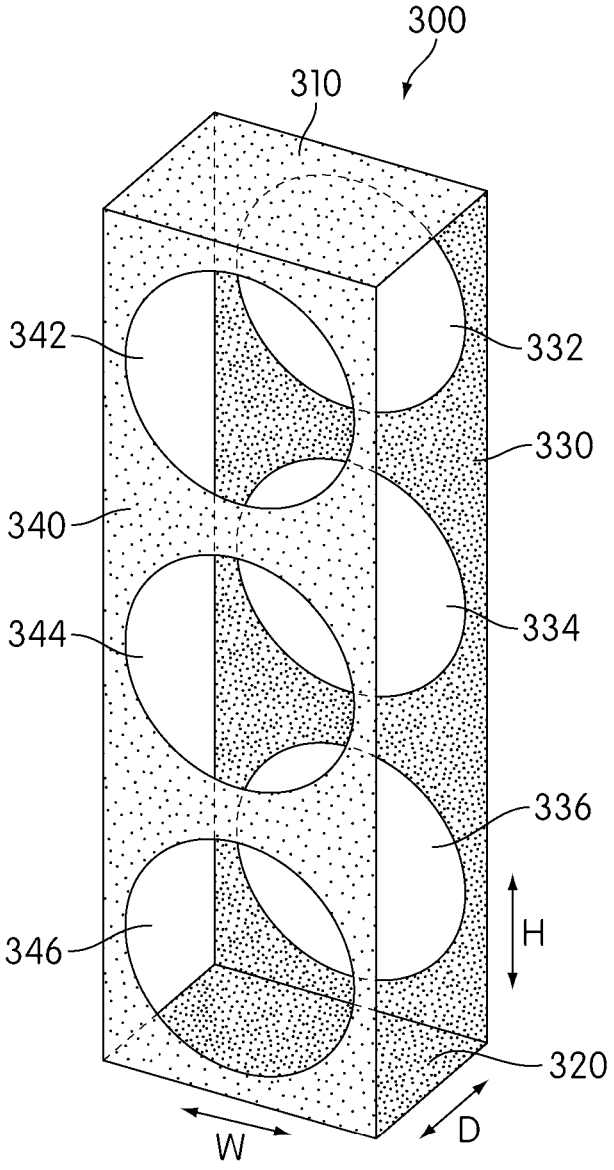
FIG. 3 is a schematic perspective view of an embodiment of a packaging sleeve.
Figure 4:
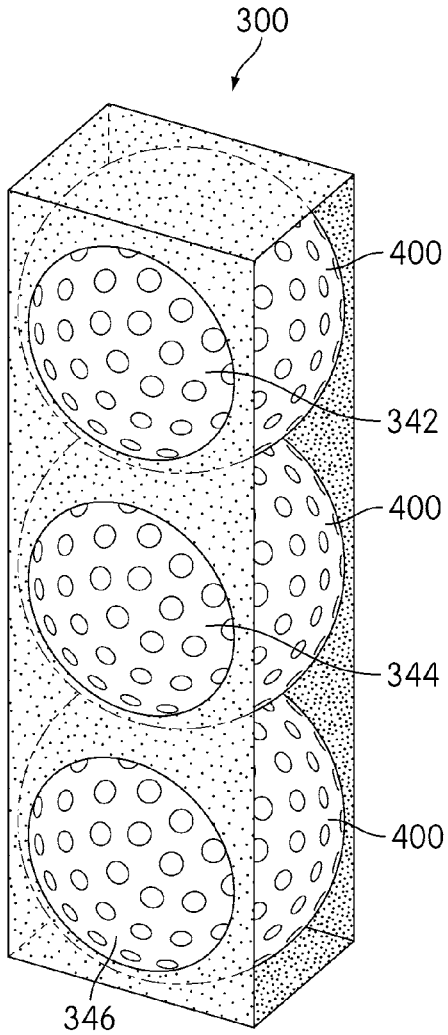
FIG. 4 is a schematic perspective view of the sleeve of FIG. 3 containing golf balls.
Figure 5:
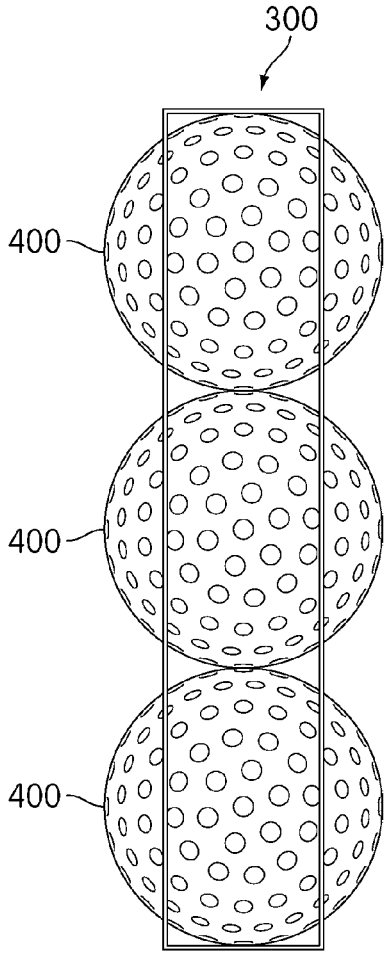
FIG. 5 is a schematic side view of the sleeve of FIG. 3.

In some embodiments, referring to FIGS. 3-5, sleeve 300 is configured to contain three golf balls. In other embodiments, sleeve 300 may be configured to contain any number of golf balls.

Sleeve 300 may be made of any material known in the art. The material may be any known paper product, including recycled, recyclable and/or post-consumer material. In some embodiments, the shape of sleeve 300 may be selected to correspond to size of the golf balls. Also, the height, the width and the depth of sleeve 300 may be selected based on the dimensions of the golf ball and number of the golf balls. For example, the height of the sleeve may be selected to correspond to the total height of golf balls. In FIGS. 3-5, sleeve 300 has a height that corresponds to three golf balls.

In some embodiments, sleeve 300 may have a rectangular shape. Sleeve 300 may have four walls and two open sides. As shown in FIGS. 3-5, sleeve 300 has four walls: first wall 310, second wall 320, third wall 330 and fourth wall 340. First wall 310 and second wall 320 extend in the width direction (labeled W) and are parallel to one another. Third wall 330 and fourth wall 340 extend in the height direction (labeled H) and are parallel to one another. Sleeve 300 does not have any walls on two opposing sides and has open opposing sides in the depth direction (labeled D). The two opposing open sides are not limited to the depth direction between first wall 310 and second wall 320. In other embodiments, sleeve 300 may have two open opposing sides in the width direction and have opposing walls in the depth and height directions.

In some embodiments, sleeve 300 may have openings in two opposing walls in the height direction. In other embodiments, sleeve 300 may have openings in one wall or on all walls.

The openings may be configured to expose a portion of the golf ball. The openings may also be configured to contact and engage the surface of the golf ball so as to inhibit or prevent movement of the ball relative to sleeve 300. The openings may generally maintain the original position of the golf ball, which is the position in which the golf ball was placed when originally packed. In some embodiments, the openings may be smaller than the diameter of an individual golf ball. In other embodiments, the openings may be smaller than the total diameter of several golf balls.

The openings may also be of any shape, such as circular, cylindrical, polygonal, or other geometrical shapes, and of any number. In some embodiments, there may be an opening in each opposing wall for each ball. In other embodiments, there may be one opening on each opposing wall that extends across all of the golf balls. The openings in opposing walls may also be symmetric. The openings, alternatively, may be asymmetric. For example, a sleeve may have an opening for each ball on one wall and have one opening extending across all of the golf balls on an opposing wall.

The open opposing walls and the openings may reduce the amount of packaging material required to contain a golf ball. Because the packaging does not need to totally cover and encompass the ball to contain a golf ball, the openings in the walls reduce the amount of packaging needed in the length direction to contain a golf ball. In other words, the length of any one wall in a package made according to embodiments of the present invention may be shorter than the length of a corresponding wall in a conventional package because the opening allows a portion of the golf ball to protrude through the wall. Also, because the openings expose portions of the ball, the openings may reduce the amount of packaging material needed in the depth direction to contain the ball. The depth of the packaging may be less than a diameter of a golf ball.

As shown in FIGS. 3-5, third wall 330 and fourth wall 340 each have three openings configured to retain a golf ball in position. Third wall 330 has first opening 332, second opening 334, and third opening 336. Fourth wall 340 has first opening 342, second opening 344, and third opening 346. The openings are circular and are the same size. The openings in third wall 330 and fourth wall 340 are also respectively symmetric. The openings in third wall 330 and fourth wall 340 may have any configuration and may be asymmetric.

As shown in FIGS. 4 and 5, sleeve 300 is configured to receive three balls 400 that are positioned adjacently in the height direction of the sleeve 300. The openings in third side 330 and fourth side 340 have a shape that is configured to inhibit movement of golf ball 400. The openings in third side 330 and fourth side 340 and open opposing side walls expose a portion of golf balls 400. The openings are circular and have a smaller diameter than the diameter of golf balls 400.

The sleeve may be sold individually or multiple sleeves may be packaged together. In some embodiments, four sleeves may be packaged together. Multiple sleeves may be packaged for example, in plastic wrap or an outer box.

An outer box may be formed of any known material. The material may be any known paper product, including recycled, recyclable and/or post-consumer material. In some embodiments, the outer box may be formed of the same material as the sleeves. An outer box may also contain balls without using a sleeve. In some embodiments, the outer box may be configured to organize the balls in groups of three balls. In other embodiments, the outer box may be configured to organize the balls so that they can be individually separated from the outer box.

Figure 6:
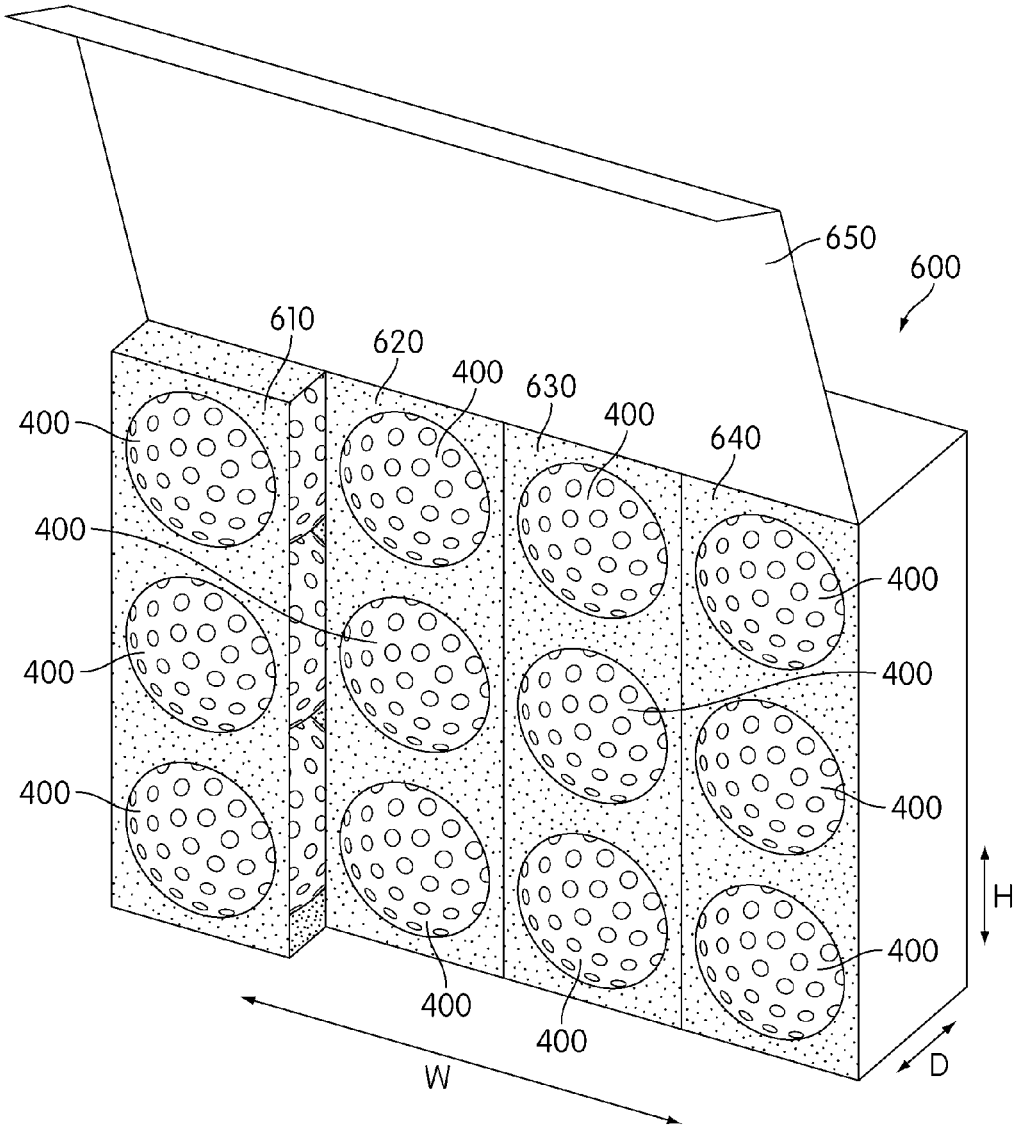
FIG. 6 is a schematic perspective view of an embodiment of a rectangular outer box.

In some embodiments, referring to FIG. 6, four sleeves may be packaged in a rectangular outer box 600. Outer box 600 may be configured to receive any number of sleeves. As shown in FIG. 6, rectangular box 600 is configured to receive four sleeves 610, 620, 630, and 640 in the width direction. Outer box 600 may be configured to receive the sleeves in the height direction.

Outer box 600 may have any type of closure or sealing device. In FIG. 6, outer box 600 has flip-top lid 650 that is attached to the outer box main body. In other embodiments, outer box 600 may have a lid that is not attached to the outer box main body and that is removable.

Figure 7:
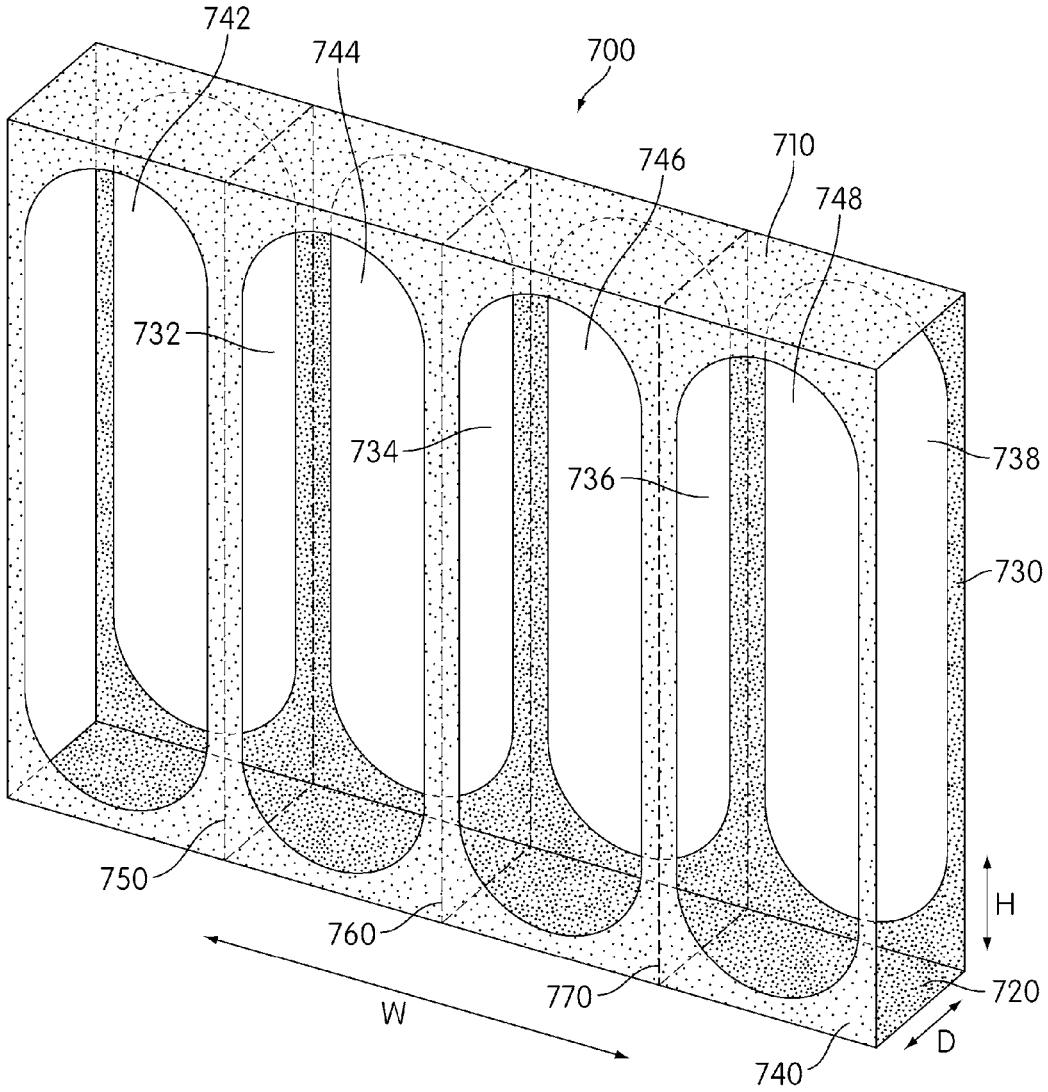
FIG. 7 is a schematic perspective view of an embodiment of a rectangular outer box.
Figure 8:
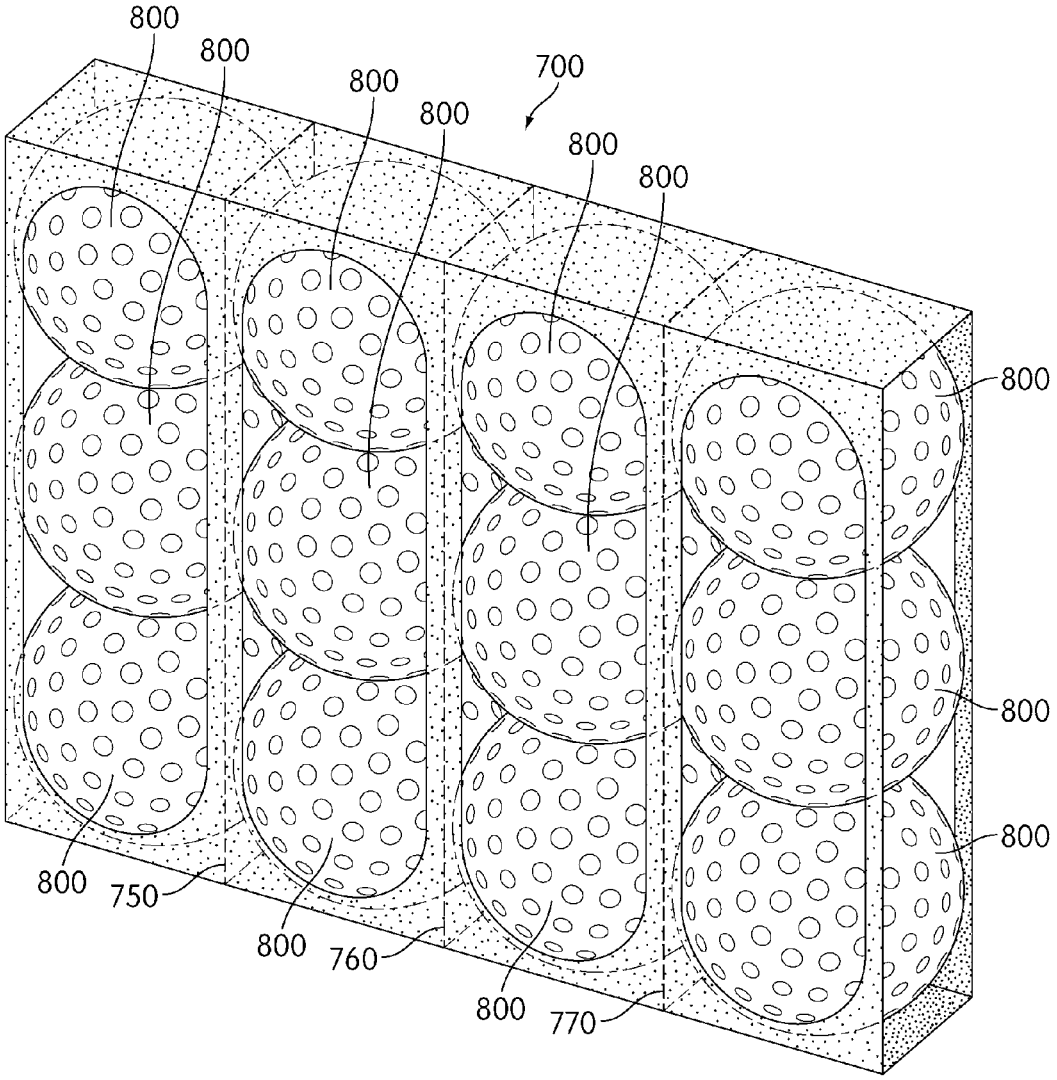
FIG. 8 is a schematic perspective view of the outer box of FIG. 7 containing golf balls.
Figure 9:
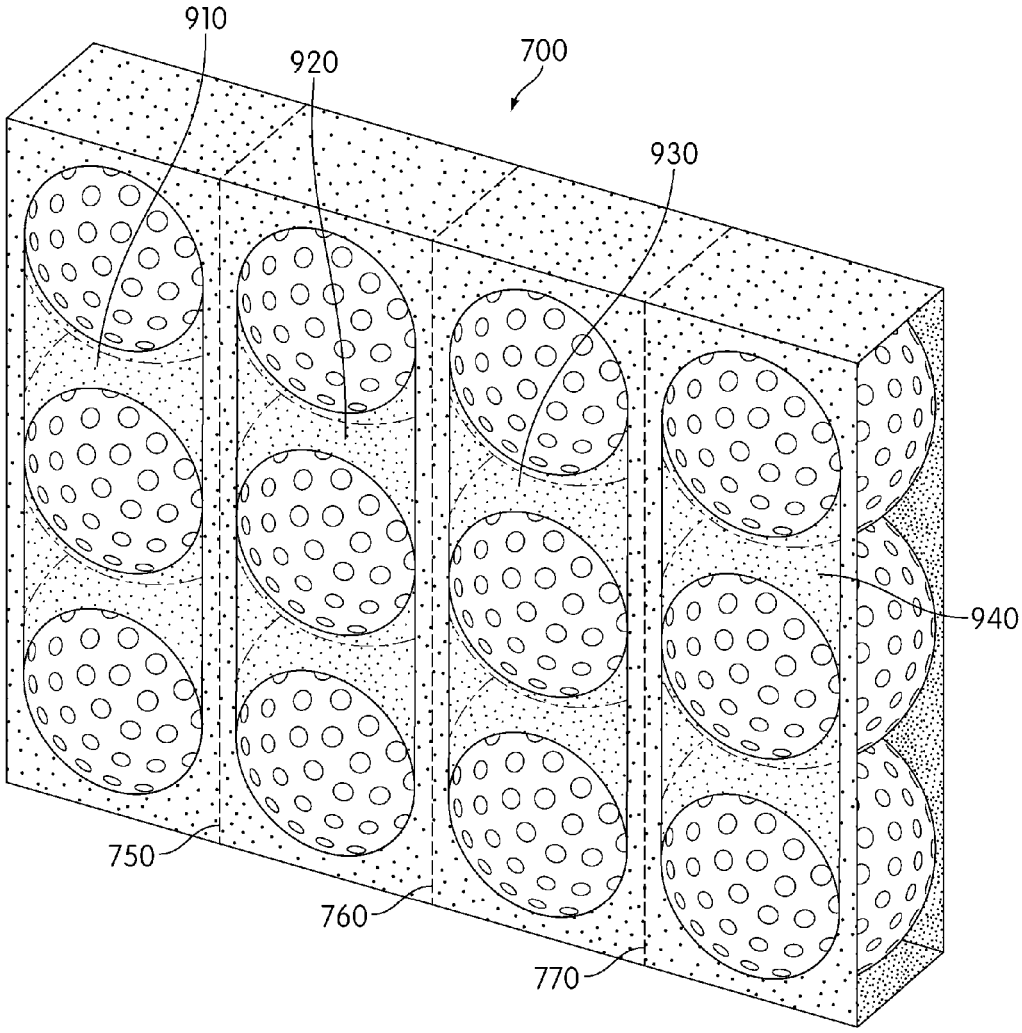
FIG. 9 is a schematic perspective view of the outer box of FIG. 7 containing an embodiment of sleeves.

In other embodiments, referring to FIGS. 7-9, a plurality of golf balls or sleeves may be packaged in an open rectangular outer box 700. Outer box 700 is configured to contain twelve balls. In other embodiments, outer box 700 may be configured to contain any number of golf balls. For example, outer box 700 may be configured to contain three golf balls like sleeve 300.

Outer box 700 also has openings. Similar to sleeve 300, these openings reduce the amount of packaging material used and are configured to restrict movement of the golf balls. The openings in the walls reduce the amount of packaging needed in the length direction to contain a golf ball. Also, because the openings expose portions of the ball, the openings may reduce the amount of packaging material needed in the depth direction to contain the ball. The depth of the packaging may be less than a diameter of a golf ball.

In one embodiment, outer box 700 has a rectangular shape with four walls and two open sides. As shown in FIGS. 7-9, outer box 700 has four walls: first wall 710, second wall 720, third wall 730, and fourth wall 740. First wall 710 and second wall 720 extend in the width direction and are parallel to one another. Third wall 730 and fourth wall 740 extend in the height direction and are parallel to one another. Outer box 700 may not have any walls on two opposing sides and has open opposing sides in the depth direction. The two opposing open sides are not limited to the depth direction between first wall 710 and second wall 720. In other embodiments, outer box 700 may have two open opposing sides in the width direction and have opposing walls in the depth and height directions.

Third wall 730 and fourth wall 740 may each have openings configured to retain a golf ball in position. Third wall 730 and fourth wall 740 each have four openings. Third wall 730 has first opening 732, second opening 734, third opening 736, and fourth opening 738. Fourth wall 740 has first opening 742, second opening 744, third opening 746, and fourth opening 748. The openings in third wall 730 and fourth wall 740 have a cylindrical shape and are also symmetric. In other embodiments, like the openings of outer box 300, as discussed above, the openings may be of any number, shape, and of different sizes. The openings in third wall 730 and fourth wall 740 may have any configuration and may be asymmetric.

Outer box 700 may have a separation device that is configured to separate the outer box into individual sleeves and/or boxes. The separation device may be any type of mechanical, chemical, or magnetic structure capable of joining together portions of outer box 700 when desired and also separating the portions when desired. In some embodiments, the separation device may be a tape or ribbon that when pulled cuts the material of outer box 700 into sleeves. In other embodiments, the separation device may include magnets. In some embodiments, the separation device may be perforations. As shown in FIGS. 7-9, outer box 700 may have perforations 750, 760, and 770 on all walls between the openings. In some embodiments, the perforations may be configured to separate outer box 700 into four sleeves having the same size and shape. In other embodiments, outer box 700 may be configured to separate into any number of sleeves and boxes. Outer box 700 may also be configured to separate into sleeves and boxes having a different size and shape. The perforations may also be on any number of walls. For example, outer box 700 may only have perforations on third wall 730 and fourth wall 740.

Referring to FIGS. 8 and 9, outer box 700 may be configured to contain a plurality of balls that may or may not be contained within another box or sleeve. In some embodiments, outer box 700 is configured to directly contain twelve balls. As shown in FIG. 8, outer box 700 is configured to contain four columns of balls, each column having three balls 800. Each of the columns may be aligned with the openings, respectively. The cylindrical openings in third wall 730 and fourth wall 740 have a shape that is configured to inhibit movement of golf balls 800. The openings in third wall 730 and fourth wall 740 and open opposing side walls expose a portion of golf balls 800. In some embodiments, each of the openings has a height smaller than the height of three golf balls 800. In other embodiments, the openings may have other shapes and sizes. The openings may also have a different orientation. For example, the openings may extend along the width direction, instead of the height direction.

In other embodiments, rectangular outer box 700 may also be configured to contain multiple sleeves of golf balls. Outer box 700 may be configured to contain any number of sleeves of any number of balls. As shown in FIG. 9, outer box 700 may be configured to contain four sleeves 910, 920, 930, and 940 of three balls 800. The four sleeves may each be similar to sleeve 300 shown in FIGS. 3-5. Outer box 700 may also be configured to receive and contain the sleeves in a different orientation by changing the configuration of the openings and sleeves, respectively.

Figure 10:
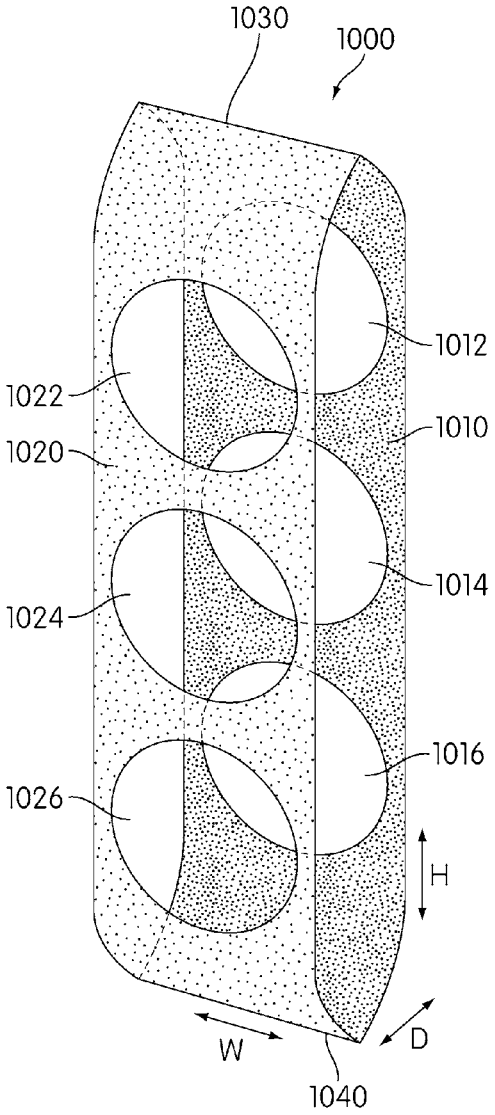
FIG. 10 is a schematic perspective view of an embodiment of a packaging sleeve.
Figure 11:
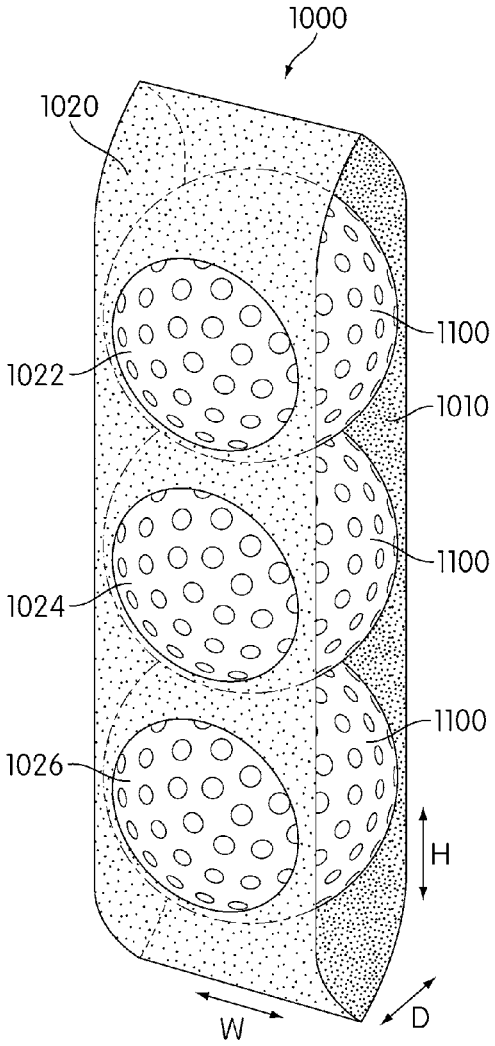
FIG. 11 is a schematic perspective view of the sleeve of FIG. 10 containing golf balls.

Sleeves may also have another configuration. FIGS. 10 and 11 show another embodiment of a sleeve that is configured to contain more than one golf ball. This configuration may result in a further reduction of packaging material. This configuration does not require a top wall and bottom wall. Also, the openings in the walls may further reduce the amount of packaging needed in the length direction to contain a golf ball. Also, because the openings expose portions of the ball, the openings may reduce the amount of packaging material needed in the depth direction to contain the ball. The depth of the packaging may be less than a diameter of a golf ball.

Sleeve 1000 is configured to contain three golf balls. In other embodiments, sleeve 1000 may be configured to contain any number of golf balls.

Sleeve 1000 has two walls and two open sides. As shown in FIGS. 10 and 11, sleeve 1000 has two walls: first wall 1010 and second wall 1020. First wall 1010 and second wall 1020 extend in the height direction and converge at seams 1030 and 1040. Sleeve 1000 does not have any walls on two opposing sides and has open opposing sides in the height direction. The two opposing open sides are not limited to the depth direction between first wall 1010 and second wall 1020. In other embodiments, sleeve 1000 may have walls that converge at seams of the walls in the depth direction and have two open opposing sides in the width direction.

First wall 1010 and second wall 1020 each have openings configured to retain a golf ball in position. As shown in FIGS. 10 and 11, first wall 1010 and second wall 1020 each have three openings. First wall 1010 has first opening 1012, second opening 1014, and third opening 1016. Second wall 1020 has first opening 1022, second opening 1024, and third opening 1026. These openings, like the openings of sleeve 300, are configured to receive three golf balls 1100. These openings are similar to the openings of sleeve 300 and the configurations of these openings, including alternative configurations, are described above.

Figure 12:
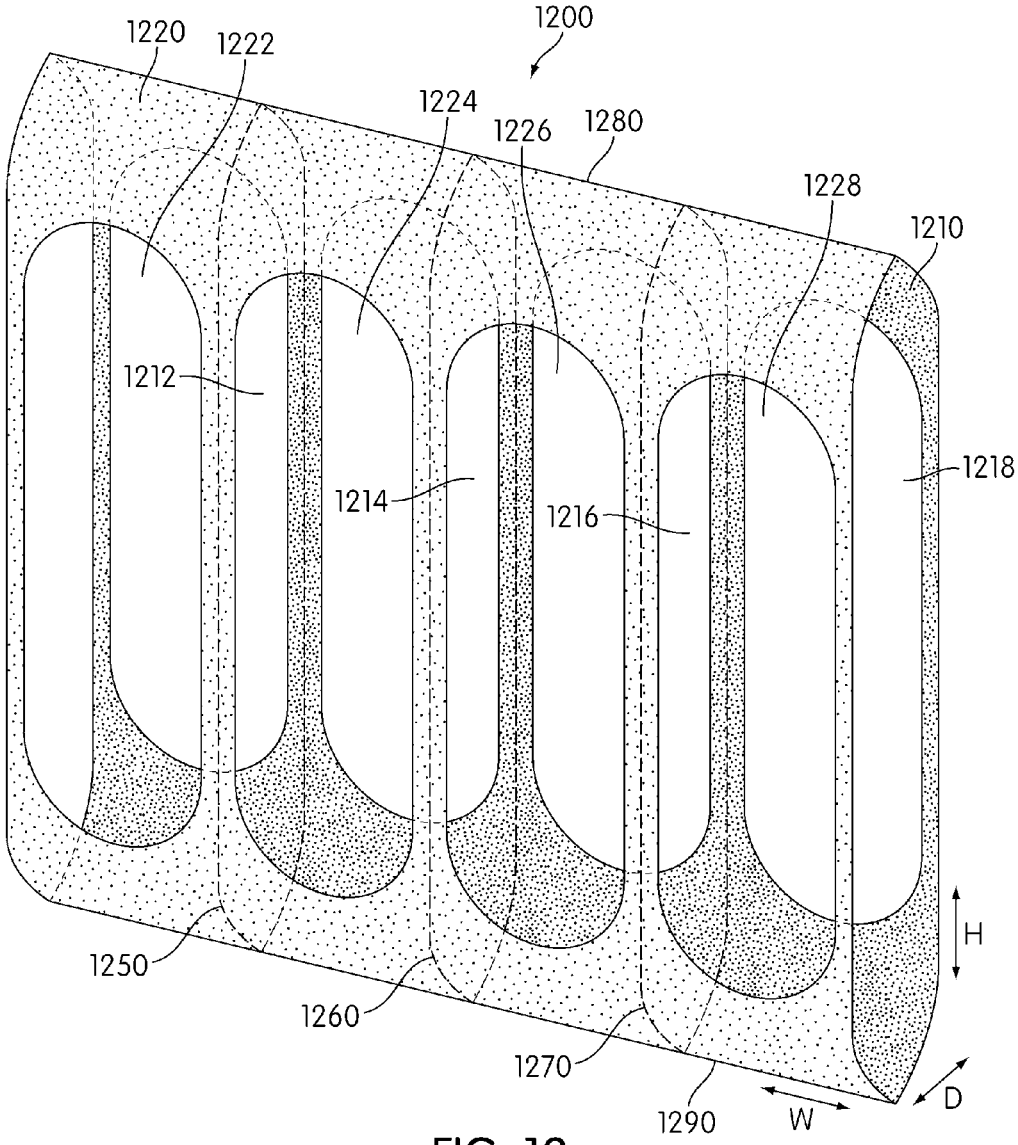
FIG. 12 is a schematic perspective view of an embodiment of a rectangular outer box.
Figure 13:
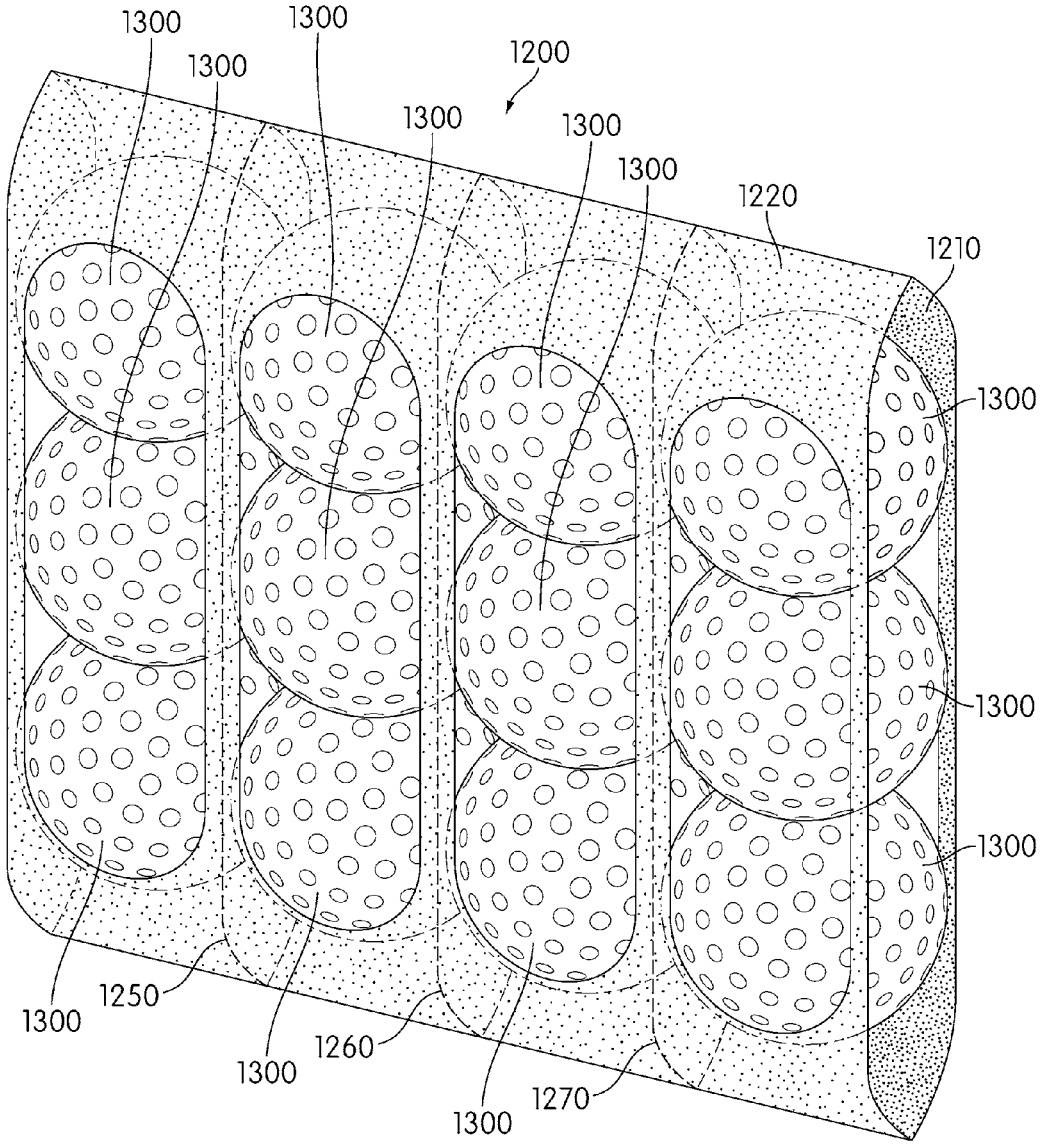
FIG. 13 is a schematic perspective view of the outer box of FIG. 12 containing golf balls.
Figure 14:
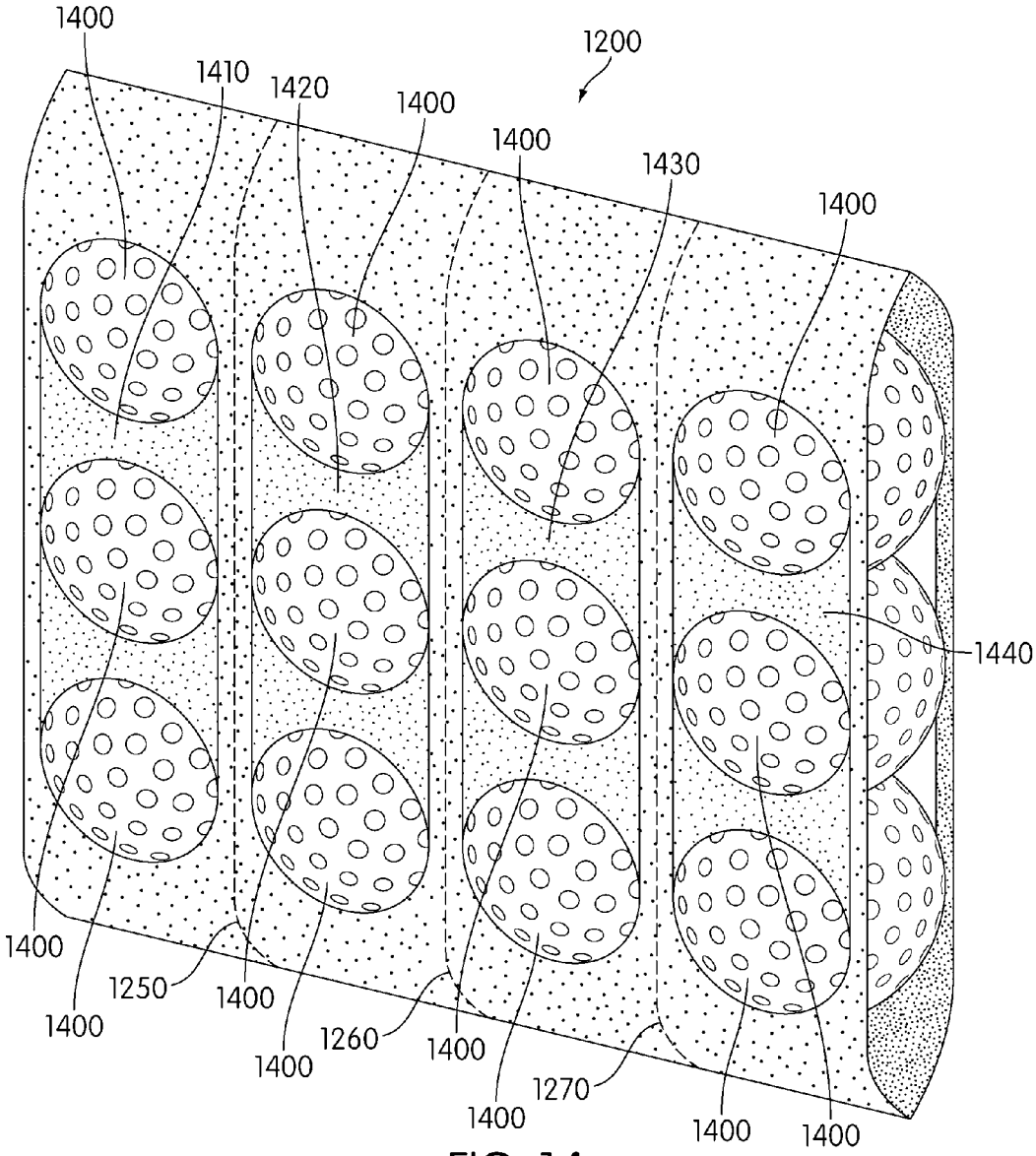
FIG. 14 is a schematic perspective view of the outer box of FIG. 12 containing an embodiment of sleeves.

Referring to FIGS. 12-14, in some embodiments, an outer box may have a similar configuration to sleeve 1000. Like outer box 700, outer box 1200 is configured to contain twelve balls. In other embodiments, outer box 1200 may be configured to contain any number of golf balls.

Outer box 1200 has two walls and two open sides. As shown in FIGS. 12-14, outer box 1200 has two walls, first wall 1210 and second wall 1220, that converge at seams 1280 and 1290 at the top and bottom. Outer box 1200 does not have any walls on two opposing sides and has open opposing sides in the depth direction. The two opposing open sides are not limited to the depth between the first wall 1210 and second wall 1220. In other embodiments, outer box 1200 may have walls that converge at the seams that extend along the height direction and have two open opposing sides in the width direction. This configuration may further reduce the amount of packaging material used as compared to the configuration shown in FIGS. 10 and 11. The larger openings may further reduce the amount of packaging material used.

First wall 1210 and second wall 1220 each have openings configured to retain a golf ball in position. First wall 1210 and second wall 1220 each have four openings. First wall 1210 has first opening 1212, second opening 1214, third opening 1216, and fourth opening 1218. Second wall 1220 has first opening 1222, second opening 1224, third opening 1226, and fourth opening 1228. These openings are similar to the openings of outer box 700 and the configurations of these openings, including alternative configurations, are described above.

Outer box 1200, like outer box 700, may also have a separation device that is configured to separate outer box 1200 into sleeves. The separation device may be perforations 1250, 1260, and 1270. As shown in FIGS. 12-14, outer box 1200 may have perforations 1250, 1260, and 1270 on all walls between the openings. The perforations may have any configuration.

Referring to FIGS. 13 and 14, like outer box 700, outer box 1200 may be configured to contain a plurality of balls that may or may not be contained within another box or sleeve. In some embodiments, outer box 1200 is configured to directly contain twelve balls. As shown in FIG. 13, outer box 1200 is configured to contain four columns of balls, each column having three balls 1300.

As shown in FIG. 14, outer box 1200 may be configured to contain four sleeves 1410, 1420, 1430, and 1440 of three balls 1400. The four sleeves may each be similar to sleeve 1000 shown in FIGS. 10 and 11. The sleeves may also have a different configuration.

Figure 15:
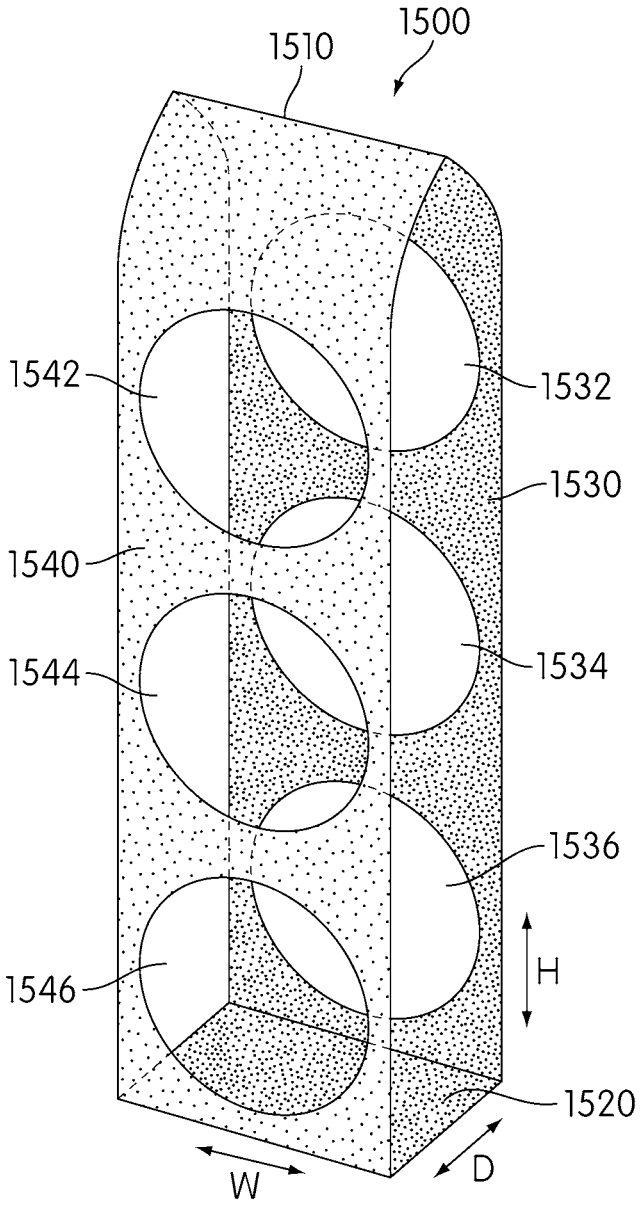
FIG. 15 is a schematic perspective view of an embodiment of a packaging sleeve.
Figure 16:
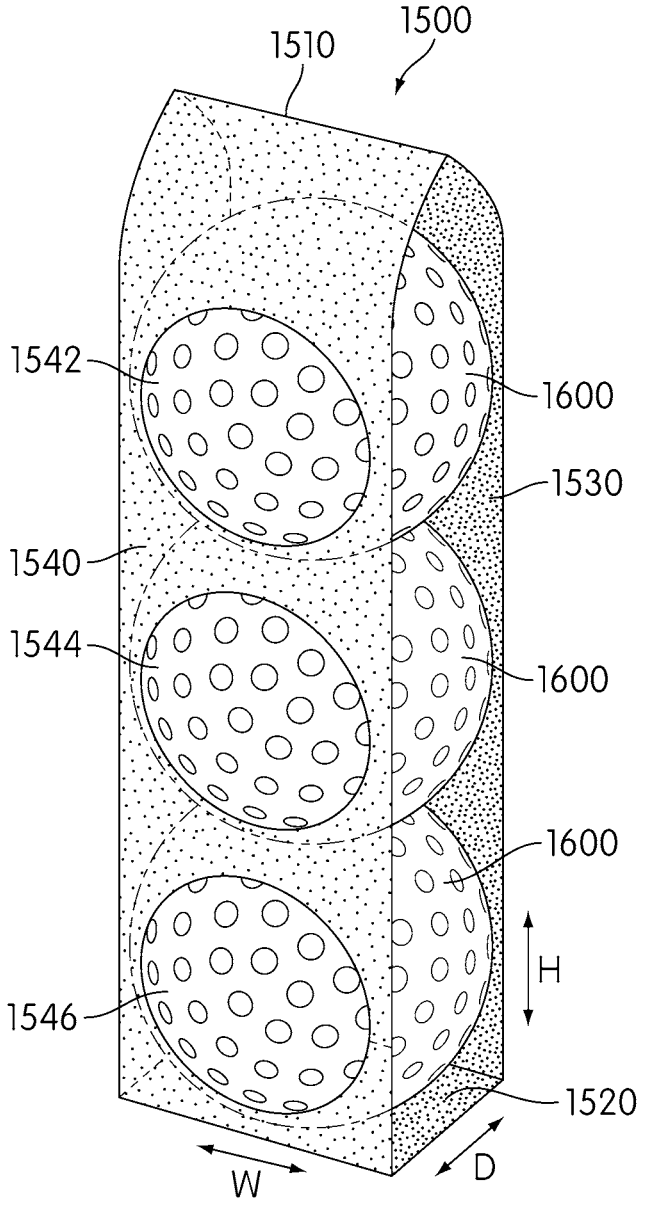
FIG. 16 is a schematic perspective view of the sleeve of FIG. 15 containing golf balls.

The sleeves and outer box may also have a different configuration. Referring to FIGS. 15 and 16, sleeve 1500 has three walls and two open sides. As shown in FIGS. 15 and 16, sleeve 1500 has three walls: first wall 1520, second wall 1530, and third wall 1540. First wall 1520 extends between second wall 1530 and third wall 1540. Second wall 1530 and third wall 1540 extend in the height direction and converge at seam 1510. Sleeve 1500 does not have any walls on two opposing sides and has open opposing sides in the depth direction. The two opposing open sides are not limited to the depth and height directions between second wall 1530 and third wall 1540. In other embodiments, sleeve 1500 may have walls along the height and depth direction of the sleeve that converge at seams at the sides of the walls in the depth direction and have two open opposing sides in the width direction.

Like sleeve 300, second wall 1530 and third wall 1540 each have openings configured to retain a golf ball in position. As shown in FIGS. 15 and 16, second wall 1530 and third wall 1540 each have three openings. Second wall 1530 has first opening 1532, second opening 1534, and third opening 1536. Third wall 1540 has first opening 1542, second opening 1544, and third opening 1546. These openings are similar to the openings of sleeve 300 and the configurations of these openings, including alternative configurations, are described above.

This configuration may reduce the amount of packaging material used to contain the golf balls. This configuration does not require a top wall. Also, the openings in the walls may further reduce the amount of packaging needed in the length direction to contain a golf ball. Also, because the openings expose portions of the ball, the openings may reduce the amount of packaging material needed in the depth direction to contain the ball. The depth of the packaging may be less than a diameter of a golf ball.

Figure 17:
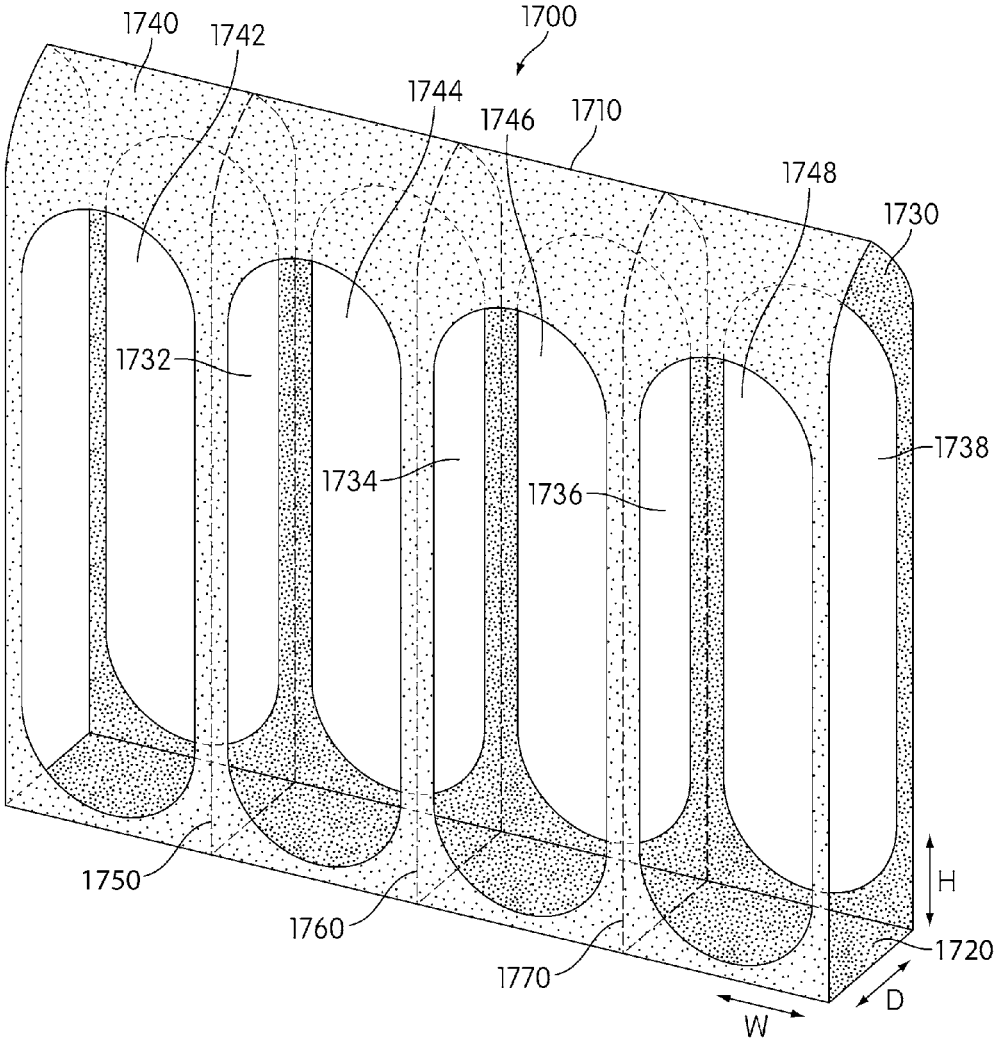
FIG. 17 is a schematic perspective view of an embodiment of a rectangular outer box.
Figure 18:
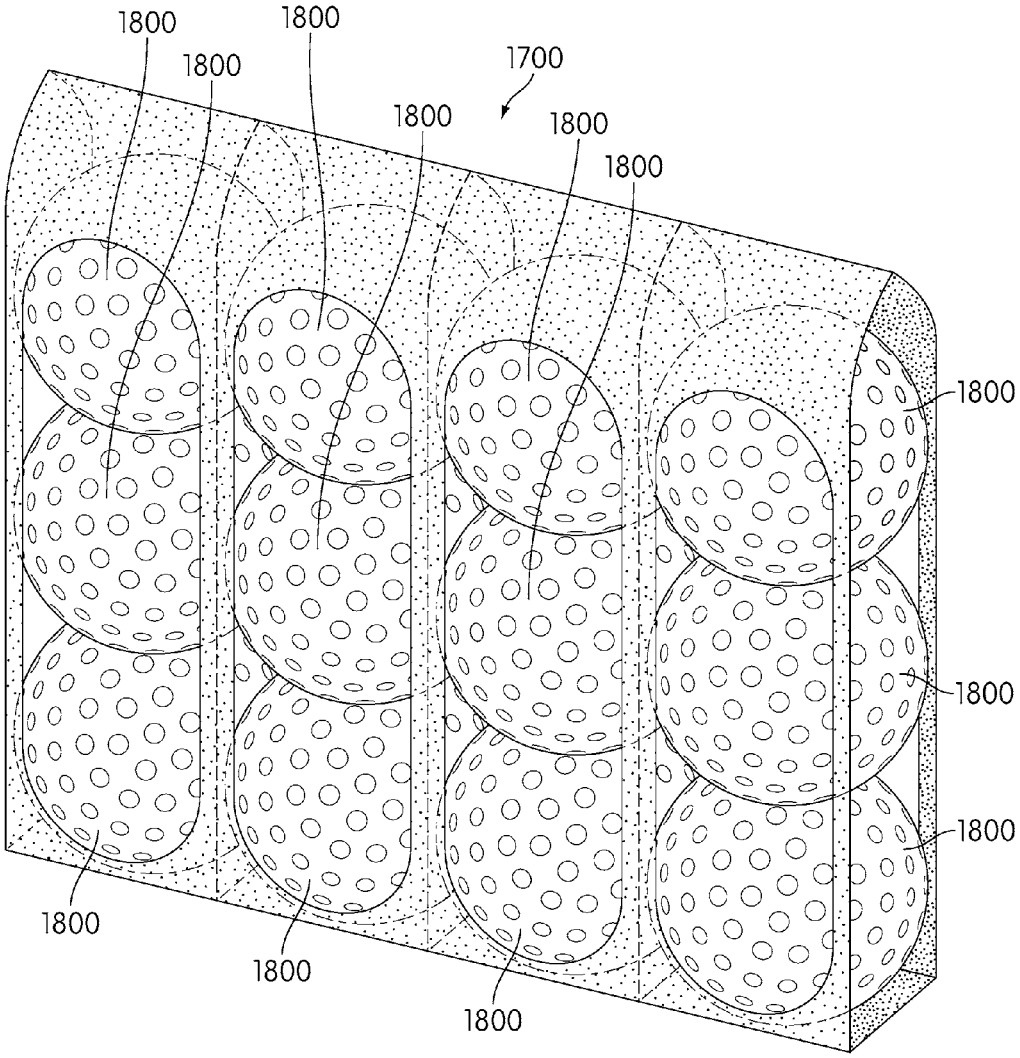
FIG. 18 is a schematic perspective view of the outer box of FIG. 17 containing golf balls.
Figure 19:
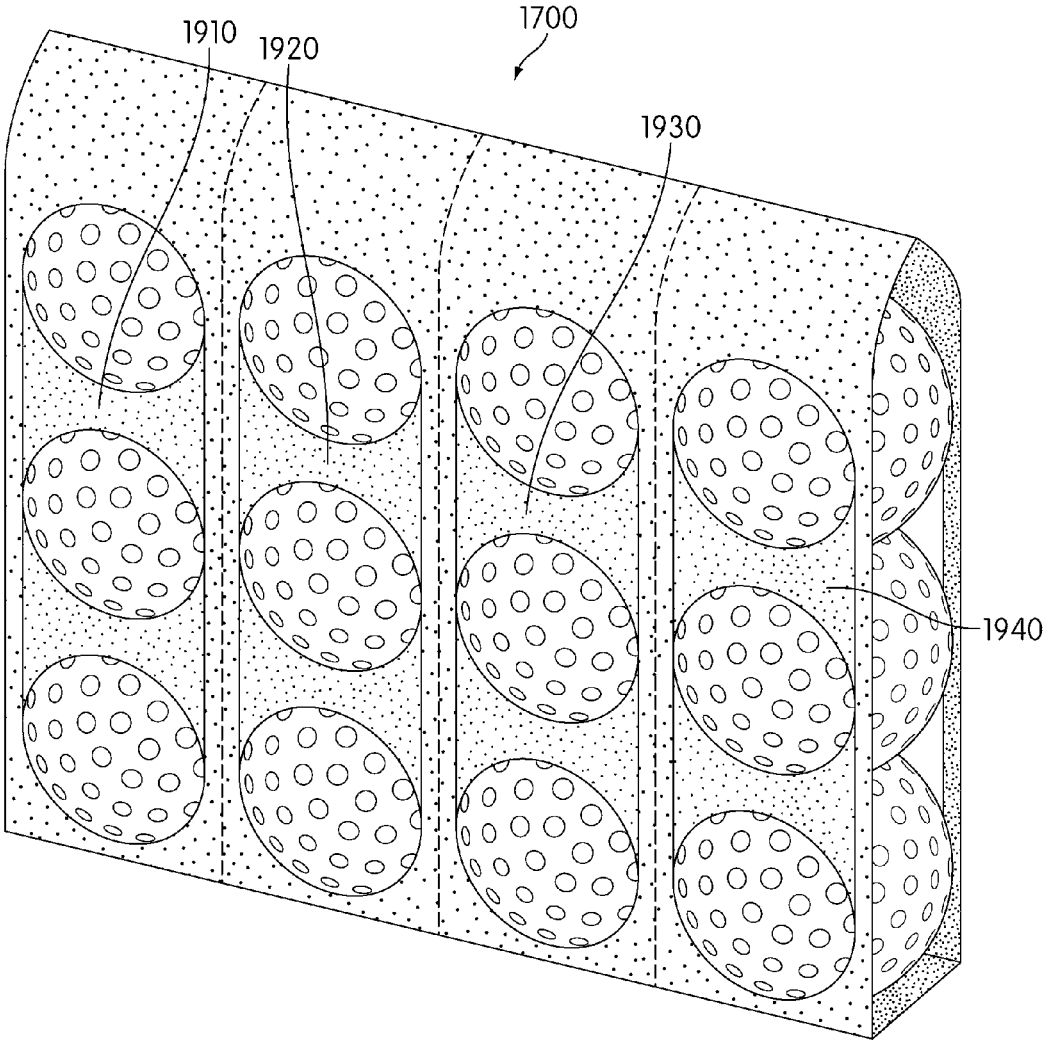
FIG. 19 is a schematic perspective view of the outer box of FIG. 17 containing an embodiment of sleeves.

Referring to 17-19, an outer box may have the same wall structure as sleeve 1500. Like sleeve 1500, outer box 1700 has three walls and two open sides. As shown in FIGS. 17-19, outer box 1700 has three walls: first wall 1720, second wall 1730, and third wall 1740. First wall 1720 extends between second wall 1730 and third wall 1740. Second wall 1730 and third wall 1740 converge at the top of outer box 1700 at seam 1710 along the width direction. Outer box 1700 does not have any walls on two opposing sides and has open opposing sides in the height direction.

Second wall 1730 and third wall 1740 each have openings configured to retain a golf ball in position. Second wall 1730 and third wall 1740 each have four openings. Second wall 1730 has first opening 1732, second opening 1734, third opening 1736, and fourth opening 1738. Third wall 1740 has first opening 1742, second opening 1744, third opening 1746 and fourth opening 1748. These openings are similar to the openings of outer box 1200 and the configurations of these openings, including alternative configurations, are described above.

Outer box 1700 may also have a separation device that is configured to separate outer box 1700 into sleeves and/or boxes. As shown in FIGS. 17-19, like outer box 1200, outer box 1700 may have perforations 1750, 1760, and 1770 on all walls between the openings.

Referring to FIGS. 18 and 19, outer box 1700 may be configured to contain a plurality of balls that may or may not be contained within another box or sleeve. In some embodiments, outer box 1700 is configured to directly contain twelve balls. As shown in FIG. 18, outer box 1700 is configured to contain four columns of balls, each column having three balls 1800. Each of the columns may be aligned with the openings, respectively. The cylindrical openings in second wall 1730 and third wall 1740 have a shape that is configured to contact a surface of golf balls 1300 to inhibit movement.

In other embodiments, outer box 1700 may also be configured to contain multiple sleeves of golf balls. Outer box 1700 may be configured to contain any number of sleeves of any number of balls. As shown in FIG. 19, outer box 1700 may be configured to contain four sleeves 1910, 1920, 1930 and 1940 of three balls 1900. The four sleeves may each be similar to sleeve 1500 shown in FIGS. 15 and 16. The sleeves may also have a different configuration. Outer box 1700 may also be configured to receive the sleeves in the height direction by changing the orientation of the openings.

Referring to FIGS. 20-23, in other embodiments, the sleeve and/or outer box may include a separation device that is capable of separating an individual ball from the sleeve and inner box, respectively. The separation device may be configured so that a user can select the number of golf balls to be separated from the sleeve or outer box. The separation device may be perforations.

Figure 20:
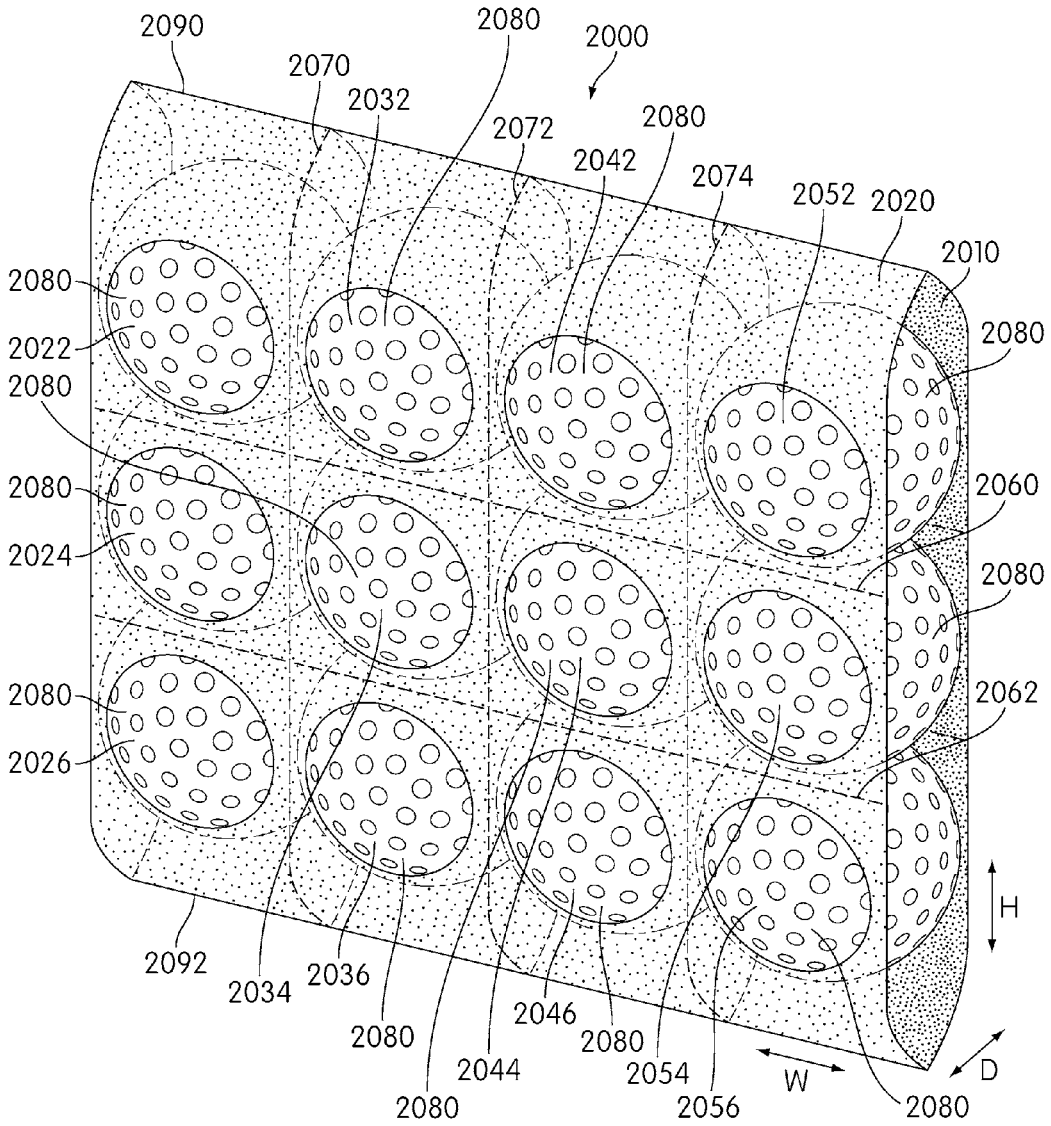
FIG. 20 is a schematic perspective view of an embodiment of a rectangular outer box.

As shown in FIG. 20, outer box 2000 has two walls and two open sides. Outer box 2000 has two walls: first wall 2010 and second wall 2020. First wall 2010 and second wall 2020 that converge at the top and bottom at seams 2090 and 2092, respectively, in the height direction. In the embodiment shown in FIG. 20, outer box 2000 does not have any walls on two opposing sides and has open opposing sides in the depth direction. The two opposing open sides are not limited to the depth direction between first wall 2010 and second wall 2020. In other embodiments, outer box 2000 may have walls that converge at the sides in the depth direction and have two open opposing sides in the width direction. Outer box 2000 may also have a third wall that extends between first wall 2010 and second wall 2020.

The walls of outer box 2000 each have openings configured to retain a golf ball in position. Each opening corresponds to a position of a golf ball. The number of openings may be varied according to the specified number of golf balls for packaging. Outer box 2000 is configured to contain twelve golf balls.

First wall 2010 and second wall 2020 each have twelve openings. The openings may be of any configuration. In some embodiments, the openings may be configured to be in four columns and three rows. The configuration of the openings may be based on the desired width or height of the outer box and number of golf balls.

As shown in FIG. 20, second wall 2020 has first opening 2022, second opening 2024, third opening 2026, fourth opening 2032, fifth opening 2034, sixth opening 2036, seventh opening 2042, eighth opening 2044, ninth opening 2046, tenth opening 2052, eleventh opening 2054 and twelfth opening 2056. In some embodiments, the openings are circular and are the same size. These openings are similar to the openings of sleeve 300 and the configurations of these openings, including alternative configurations, are described above.

In some embodiments, outer box 2000 may also have a separation device that is configured to separate outer box 2000 into individual balls, sleeves and/or boxes. The separation device may be perforations 2060 and 2062 that divide golf balls 2080 into three rows and perforations 2070, 2072, and 2074 that divide golf balls 2080 into four columns. As shown in FIG. 20, outer box 2000 may have the perforations on all the walls and between every opening so as to be capable of dividing outer box 2000 by individual golf ball 2080. In some embodiments, the perforations may only be between certain openings. The perforations may be configured only to separate outer box 2000 into four sleeves of three golf balls 2080 having the same size and shape. In other embodiments, outer box 2000 may be configured to separate into any number of sleeves and boxes. Outer box 2000 may also be configured to separate into sleeves and boxes having a different size and shape.

Figure 21:
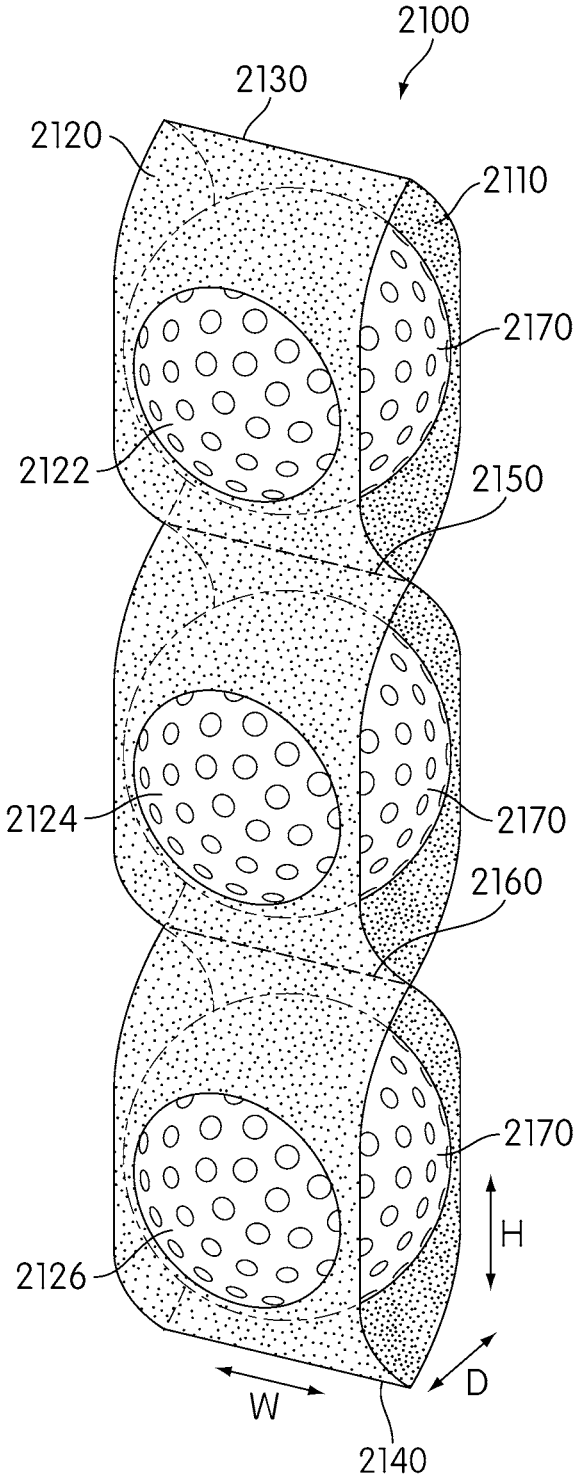
FIG. 21 is a schematic perspective view of an embodiment of a packaging sleeve.
Figure 22:
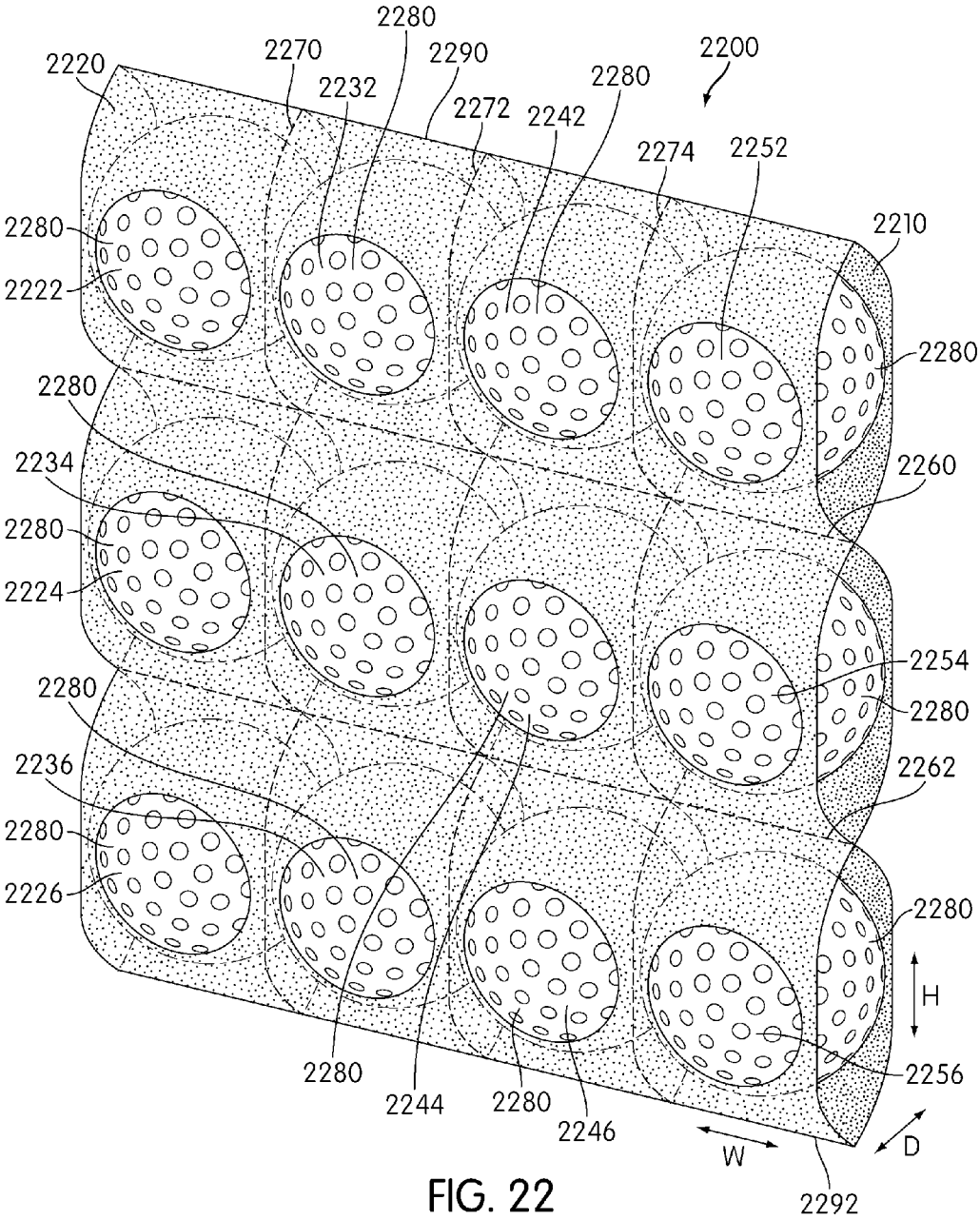
FIG. 22 is a schematic perspective view of an embodiment of a rectangular outer box.

In other embodiments, referring to FIGS. 21 and 22, the sleeve and outer box may be configured to provide further containment of the golf balls. Further containment may be provided by configuring the sleeve and outer box to have an additional contact surface.

FIG. 21 shows sleeve 2100 that is configured to form a supportive pocket around golf ball. Like sleeve 1000, sleeve 2100 has two walls and two open sides. Sleeve 2100 has two walls: first wall 2110 and second wall 2120. First wall 2110 and second wall 2120 extend in the height direction and converge at seams 2130 and 2140. First wall 2110 and second wall 2120 also converge at intervening seams 2150 and 2160. These intervening sleeves may create a containment and protective pocket for a golf ball. Sleeve 2100 does not have any walls on two opposing sides and has open opposing sides in the depth direction. Sleeve 2100 may also be configured to change the orientation of the seams and open opposing sides like sleeve 1000.

First wall 2110 and second wall 2120 each have openings configured to retain a golf ball in position. As shown in FIG. 21, first wall 2110 and second wall 2120 each have three openings. Second wall 2120 has first opening 2122, second opening 2124, and third opening 2126. First wall 2110 has openings similar to the openings of second wall 2120 (that are not shown). Each of these openings, like the openings of sleeve 300, is configured to receive three golf balls 2170. These openings are similar to the openings of sleeve 300 and the configurations of these openings, including alternative configurations, are described above.

One or all of the intervening seams may be a separation device. Referring to FIG. 21, seams 2150 and 2160 may be perforations.

Referring to FIG. 22, an outer box may have a similar configuration as sleeve 2100. Outer box 2200 may have four columns of sleeves like sleeves 2100. Outer box 2200 has two walls, first wall 2210 and second wall 2220, and open opposing sides. First wall 2210 and second wall 2220 converge at the top and bottom at seams 2290 and 2092, respectively, in the width direction. Outer box 2200 does not have any walls on two opposing sides and has open opposing sides in the depth direction.

Outer box 2200 further includes intervening seams 2260 and 2262 between first wall 2210 and second wall 2220. These seams, like seams 2150 and 2160, may create a containment and protective pocket for a ball.

Like, outer box 2000, outer box 2200 has openings that each corresponds to a position of a golf ball. Second wall 2220 has first opening 2222, second opening 2224, third opening 2226, fourth opening 2232, fifth opening 2234, sixth opening 2236, seventh opening 2242, eighth opening 2244, ninth opening 2246, tenth opening 2252, eleventh opening 2254, and twelfth opening 2256. The openings of first wall 2210 are identical to the openings of second wall 2220 and are not shown. These openings are similar to the openings of outer box 2000 and the configurations of these openings, including alternative configurations, are described above.

In some embodiments, outer box 2200 may also have a separation device that is configured to separate outer box 2200 into individual balls, sleeves and/or boxes. The intervening seams 2260 and 2262 may be perforations. Also, outer box 2200 may also include perforations 2270, 2272, and 2274 that divide golf balls 2280 into four columns. As shown in FIG. 22, outer box 2200 may have perforations on all the walls and between every opening so as to be capable of dividing outer box 2200 by individual golf ball 2280. Like outer box 2000, outer box 2200 may be configured to separate into any number of sleeves and boxes.

In some embodiments like those discussed above, outer boxes may be configured to have identical four columns of golf balls. In other embodiments, outer boxes may be configured to have staggered columns of golf balls. The columns may be staggered by varying the heights of the columns of golf balls. In some embodiments, referring to FIGS. 23-29, outer boxes may have a first column and a third column that are at a first height and a second column and a fourth column that are at a second height different from the first height. In other embodiments, the columns of golf balls may be of any height configuration. The columns may be of all different heights. The outer boxes may also have a different configuration by varying the number of columns and the number of golf balls.

Multiple outer boxes that have staggered columns may be used organized to prevent further movement while shipping. The multiple outer boxes may be packed within a shipping box in a staggered configuration within the shipping box by associating the balls of different columns with one another. For example, the first column of a first staggered outer box may be adjacent to the second column of a second staggered outer box.

In some embodiments, referring to FIGS. 23-28, an outer box may have a staggered configuration by staggering directly adjacent columns only in the height direction. The columns may also have the same depth. In other embodiments, referring to FIGS. 29 and 30, an outer box may have a staggered configuration of two rows of two columns.

Figure 23:
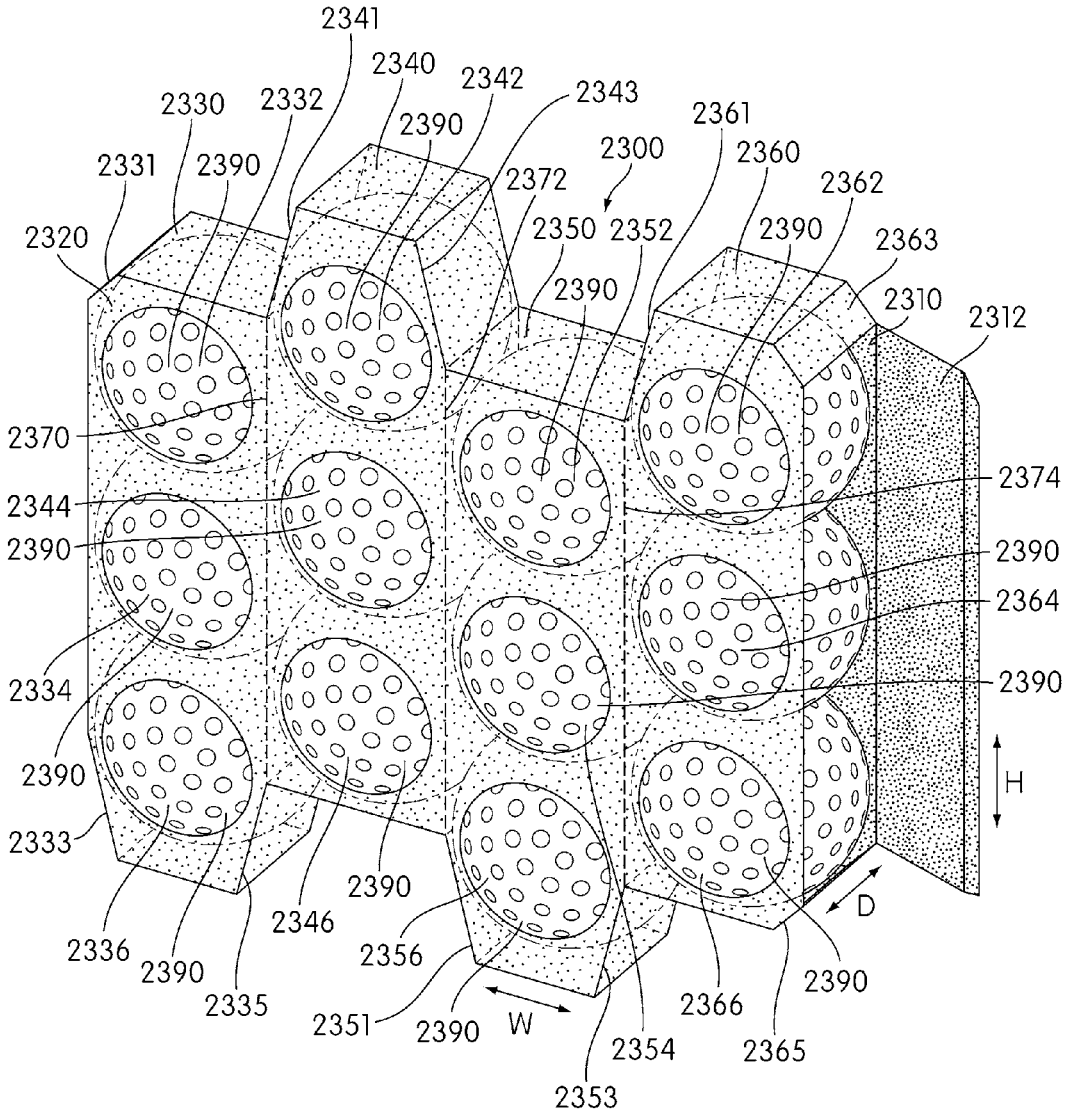
FIG. 23 is a schematic perspective view of an embodiment of a staggered outer box.
Figure 24:
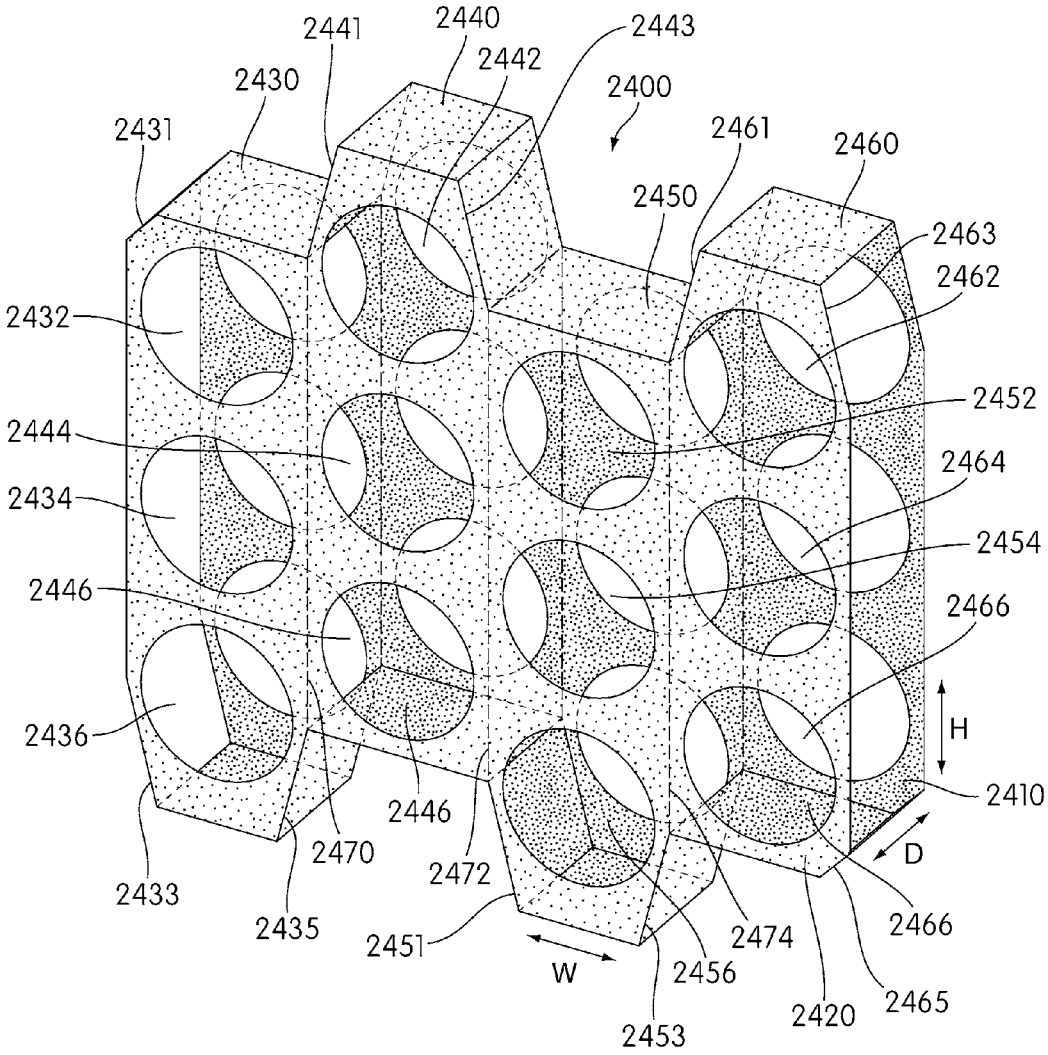
FIG. 24 is a schematic perspective view of an embodiment of a staggered outer box.

FIG. 23 illustrates an embodiment of an outer box having a staggered configuration. Outer box 2300 is configured to contain twelve balls. Outer box 2300 has four columns of balls: first column 2330, second column 2340, third column 2350, and fourth column 2360. Each column is configured to contain three balls. Each column has a net height that corresponds to three golf balls. First column 2330 and third column 2350 are at a first height, and second column 2340 and fourth column 2360 are at a second height. The first height starts and ends higher than the second height.

Each column may have a flat top and bottom. The flat top and bottom is configured to enable stacking and positioning of the outer box on a shelf and within a shipping box without movement from its original position. The columns of outer box 2300 may also include angled corners. The angled corners may be disposed on the side of the column that is exposed. In FIG. 23, first column 2330 has first angled corner 2331, second angled corner 2333, and third angled corner 2335; second column 2340 has first angled corner 2341 and second angled corner 2343; third column 2350 has first angled corner 2351 and second angled corner 2353; and fourth column 2360 has first angled corner 2361, second angled corner 2363, and third angled corner 2365. The angled corners in first wall 2310 (not shown) and second wall 2320 are symmetric. The angled corners may assist in the alignment of the golf balls within each column. The angled corners may also further reduce the packaging material.

Each column also has three openings. First column 2330 has first opening 2332, second opening 2334, and third opening 2336; second column 2340 has first opening 2342, second opening 2344, and third opening 2346; third column 2350 has first opening 2352, second opening 2354, and third opening 2356; and fourth column 2360 has first opening 2362, second opening 2364, and third opening 2366. The columns have these openings in first wall 2310 (not shown) and second wall 2320. The openings of first wall 2310 and second wall 2320 are symmetric. These openings are similar to the openings of outer box 2000 and the configurations of these openings, including alternative configurations, are described above.

Outer box 2300 may have any type of closure or sealing device. In FIG. 23, outer box 2300 has flip-top lid 2312 that is attached to the outer box main body. In other embodiments, outer box 2300 may have a lid that is not attached to the outer box main body and that is removable.

In some embodiments, outer box 2300 may also have a separation device that is configured to separate outer box 2300 into individual balls, sleeves and/or boxes. The separation device may be perforations. Outer box 2300 may include perforations 2370, 2372, and 2374 that are between each column and divide golf balls 2280 into four columns. Outer box 2300 may be configured to separate into any number of sleeves and boxes.

Figure 25:
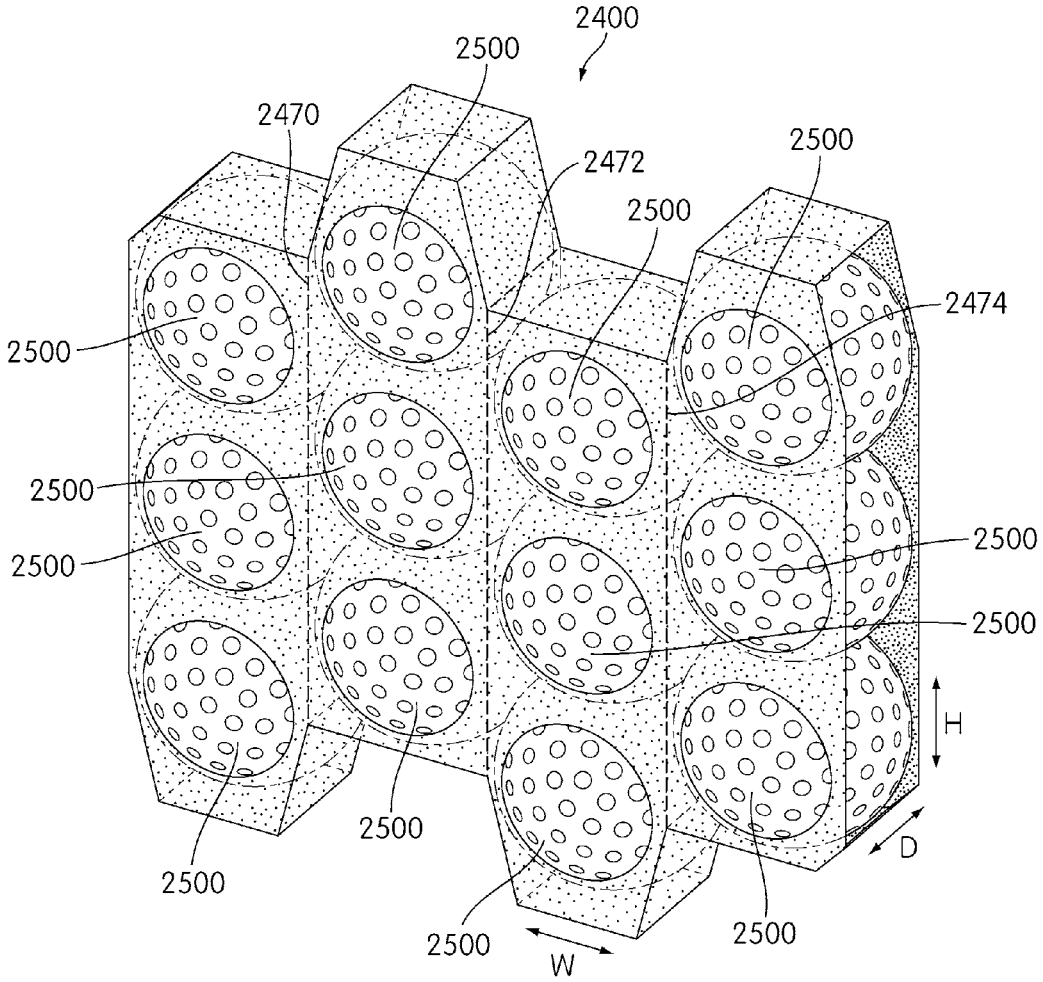
FIG. 25 is a schematic perspective view of the outer box of FIG. 24 containing golf balls.

In some embodiments, outer box 2300 may have walls on every side. In other embodiments, referring to FIGS. 24 and 25, outer box 2400 may have open side walls. As shown in FIG. 25, outer box 2400 is configured to contain twelve golf balls 2500.

Outer box 2400, like outer box 2300, has four columns of balls: first column 2430, second column 2440, third column 2450, and fourth column 2460. Each column is configured to contain three balls. Each column may have a flat top and bottom. The flat top and bottom is configured to enable stacking and positioning of the outer box on a shelf and within a shipping box without movement from its original position.

The columns of outer box 2400 may also include angled corners. The angled corners may be disposed on the side of the column that is exposed. First column 2430 has first angled corner 2431, second angled corner 2433, and third angled corner 2435; second column 2440 has first angled corner 2441 and second angled corner 2443; third column 2450 has first angled corner 2451 and second angled corner 2453; and fourth column 2460 has first angled corner 2461, second angled corner 2463, and third angled corner 2465. The angled corners in first wall 2410 (not shown) and second wall 2420 are symmetric. The angled corners may assist in the alignment of the golf balls within each column. The angled corners may also further reduce the packaging material.

Each column also has three openings. First column 2430 has first opening 2432, second opening 2434, and third opening 2436; second column 2440 has first opening 2442, second opening 2444, and third opening 2446; third column 2450 has first opening 2452, second opening 2454, and third opening 2456; and fourth column 2460 has first opening 2462, second opening 2464, and third opening 2466. The columns have these openings in first wall 2410 (not labeled) and second wall 2420. The openings of first wall 2410 and second wall 2420 are symmetric. These openings are similar to the openings of outer box 2000 and the configurations of these openings, including alternative configurations, are described above.

Outer box 2400 does not have any side walls extending in the depth direction and has open opposing sides. The side walls are not necessary because the openings maintain the position of the ball within the box.

In some embodiments, outer box 2400 may also have a separation device that is configured to separate outer box 2400 into individual balls, sleeves and/or boxes. The separation device may be perforations. Outer box 2400 may include perforations 2470, 2472, and 2474 that are between each column and divide golf balls 2480 into four columns. Outer box 2400 may be configured to separate into any number of sleeves and boxes.

Figure 26:
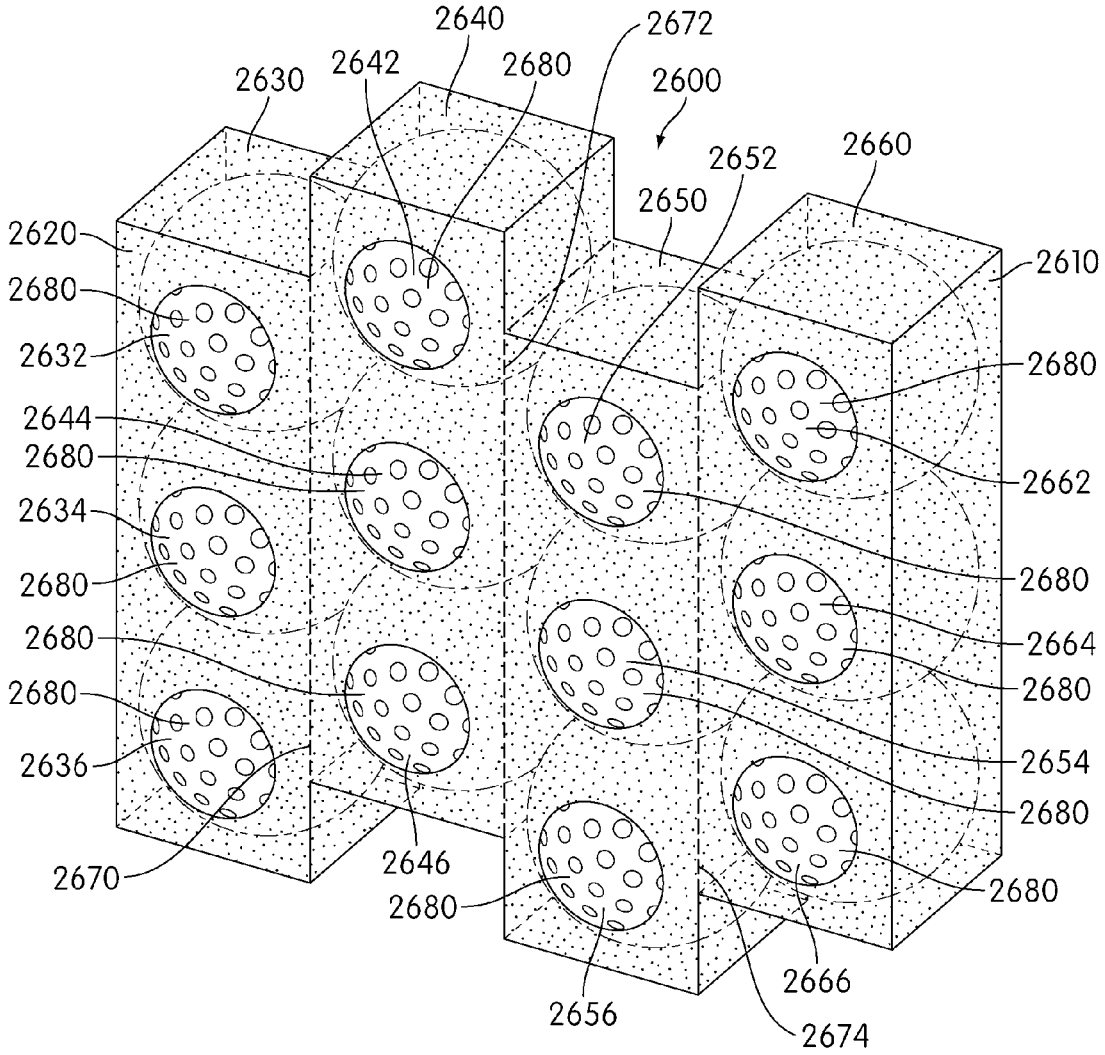
FIG. 26 is a schematic perspective view of an embodiment of a staggered outer box.
Figure 27:
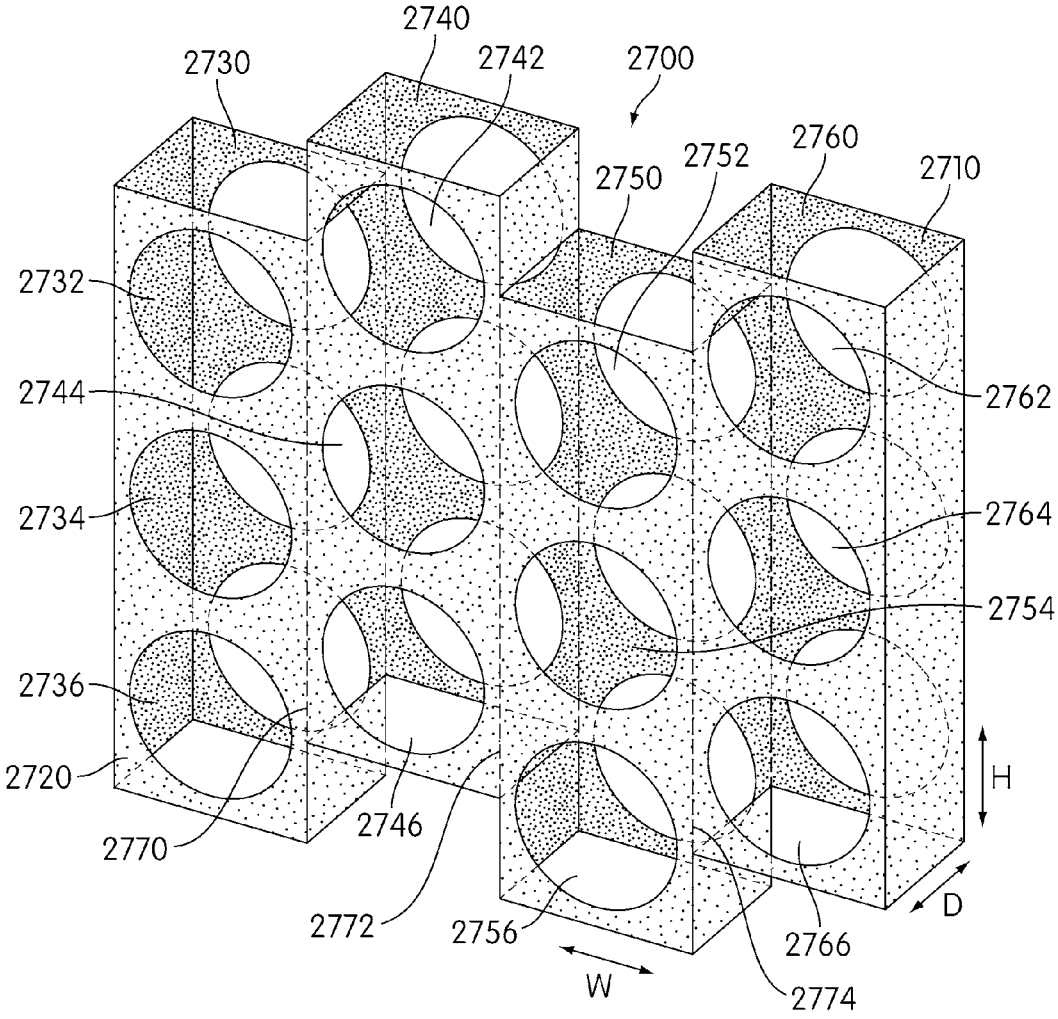
FIG. 27 is a schematic perspective view of an embodiment of a staggered outer box.
Figure 28:
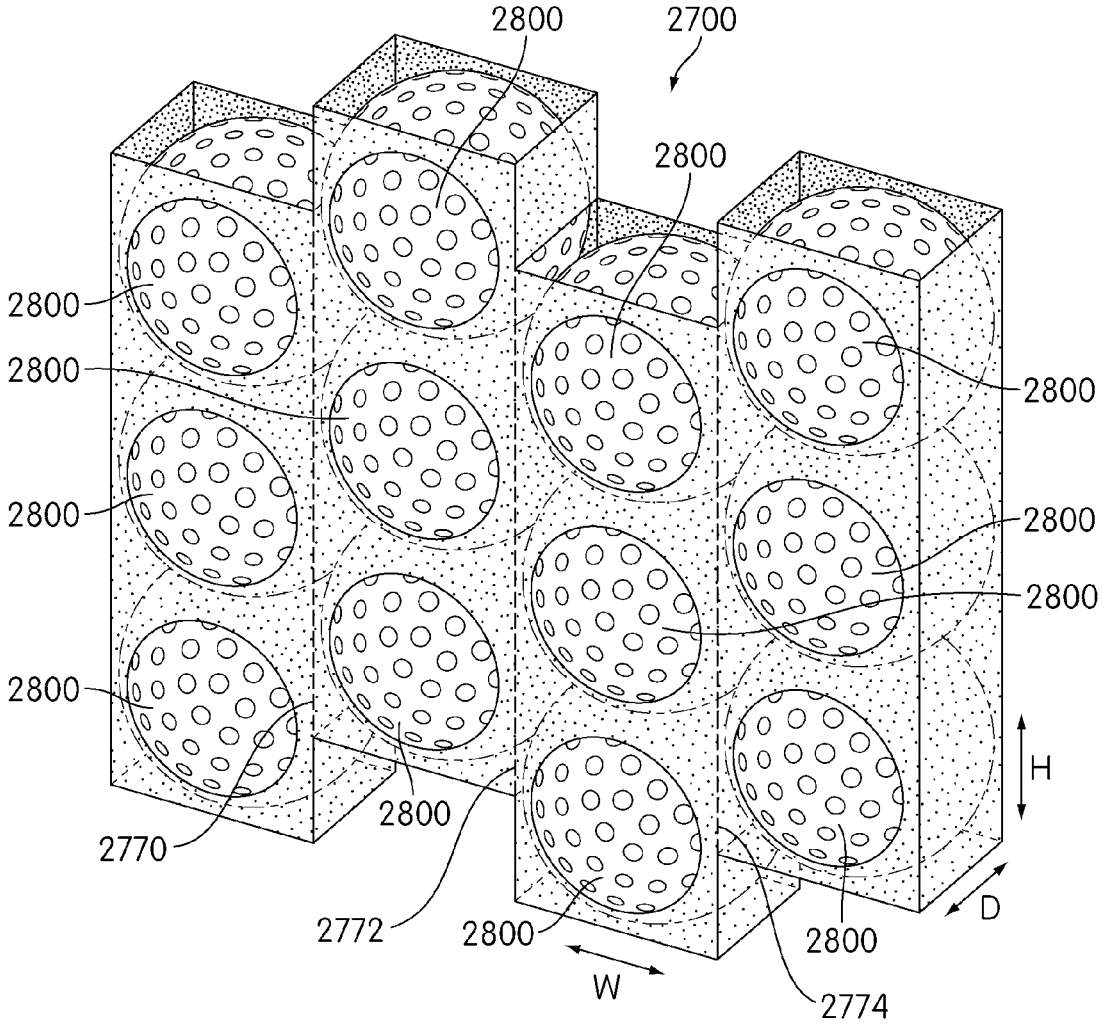
FIG. 28 is a schematic perspective view of the outer box of FIG. 27 containing golf balls.

Outer box may also be configured to have straight edges. Referring to FIGS. 26-28, each column may have straight edges.

FIG. 26 illustrates an embodiment of a staggered outer box with straight edges. Outer box 2600 is configured to contain twelve balls. Outer box 2600 has four columns of balls: first column 2630, second column 2640, third column 2650, and fourth column 2660. Like outer box 2400, each column is configured to contain three balls and has a net height that corresponds to three golf balls. First column 2630 and third column 2650 are at a first height, and second column 2640 and fourth column 2660 are at a second height that is higher than the first height.

Each column has a flat top and bottom and also has three openings. First column 2630 has first opening 2632, second opening 2634, and third opening 2636; second column 2640 has first opening 2642, second opening 2644, and third opening 2646; third column 2650 has first opening 2652, second opening 2654, and third opening 2656; and fourth column 2660 has first opening 2662, second opening 2664, and third opening 2666. The columns have these openings in first wall 2610 (not shown) and second wall 2620. The openings of first wall 2610 and second wall 2620 are symmetric. These openings are similar to the openings of outer box 2000 and the configurations of these openings, including alternative configurations, are described above.

Outer box 2600 may have any type of closure or sealing device. Outer box 2600 may have a flip-top lid that is attached to the outer box main body. or a lid that is not attached to the outer box main body and that is removable.

In some embodiments, outer box 2600 may also have a separation device that is configured to separate outer box 2600 into individual balls, sleeves and/or boxes. Outer box 2600 may include perforations 2670, 2672, and 2674 that are between each column and divide golf balls 2680 into four columns. Outer box 2600 may be configured to separate into any number of sleeves and boxes.

In some embodiments, outer box 2600 may have walls on every side. In other embodiments, referring to FIGS. 27 and 28, outer box 2700 may have open side walls. As shown in FIG. 28, outer box 2700 is configured to contain twelve golf balls 2800.

Outer box 2700, like outer box 2600, has four columns of balls: first column 2730, second column 2740, third column 2750, and fourth column 2760. Each column is configured to contain three balls and has three openings. First column 2730 has first opening 2732, second opening 2734, and third opening 2736; second column 2740 has first opening 2742, second opening 2744, and third opening 2746; third column 2750 has first opening 2752, second opening 2754, and third opening 2756; and fourth column 2760 has first opening 2762, second opening 2764, and third opening 2766. The columns have these openings in first wall 2710 (not labeled) and second wall 2720. The openings are symmetric on first wall 2710 and second wall 2720. These openings are similar to the openings of outer box 2000 and the configurations of these openings, including alternative configurations, are described above.

Outer box 2700 does not have walls on the top and bottom sides extending in the width direction and has open opposing sides in the depth direction. These walls are not necessary because the openings maintain the position of the ball within the box.

In some embodiments, outer box 2700 may also have a separation device that is configured to separate outer box 2700 into individual balls, sleeves and/or boxes. The separation device may be perforations. Outer box 2700 may include perforations 2770, 2772, and 2774 that are between each column and divide golf balls 2780 into four columns. Outer box 2700 may be configured to separate into any number of sleeves and boxes.

Figure 29:
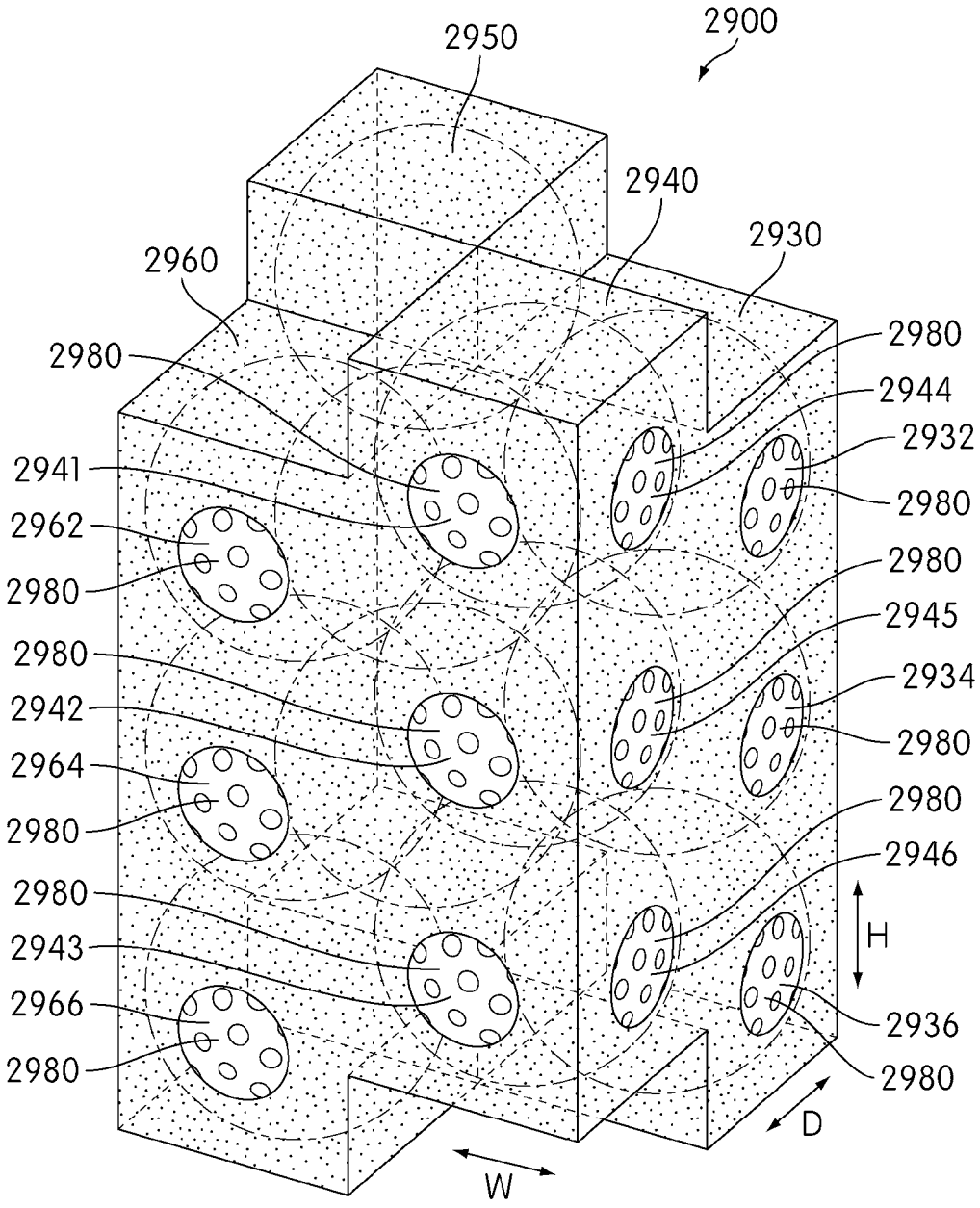
FIG. 29 is a schematic perspective view of an embodiment of a staggered outer box.
Figure 30:
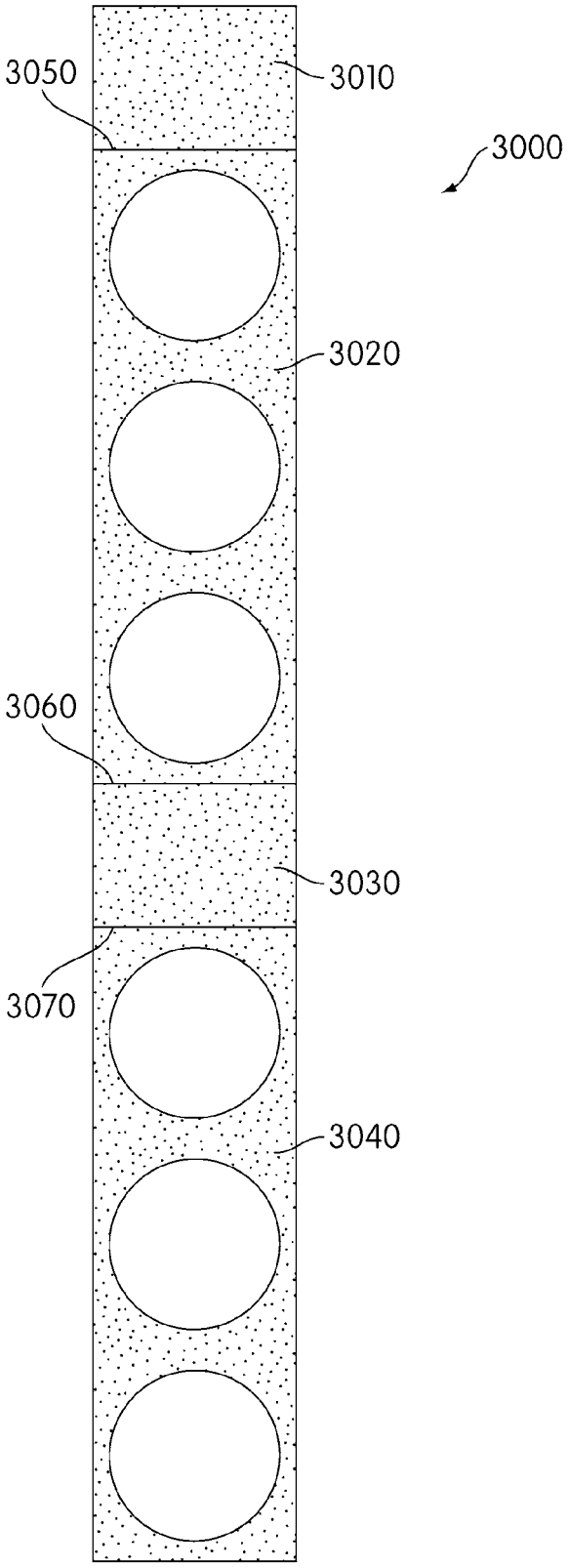
FIG. 30 is a schematic front view of a blank from which an embodiment of a sleeve may be formed.

Referring to FIG. 29, outer box 2900 may have staggered columns in the height direction that are configured to have two columns and two rows of columns. Outer box 2900 may have straight edges and corners. In other embodiments, outer box 2900 may have angled edges and corners that correspond to the circular angle of the golf ball.

Outer box 2900 is configured to contain twelve balls. Outer box 2900 has four columns of balls: first column 2930, second column 2940, third column 2950, and fourth column 2960. Like outer box 2400, each column is configured to contain three balls and has a net height that corresponds to three golf balls. First column 2930 and fourth column 2960 are at a first height, and second column 2940 and third column 2950 are at a second height that is higher than the first height. First column 2930 is symmetric with fourth column 2960 and second column 2940 is symmetric with third column 2950.

Each column may a flat top and bottom. Also, in some embodiments, each column may have three openings in each exposed surface for a total of six openings. In other embodiments, the openings may vary for each column and may be different for each column.

As shown in FIG. 29, first column 2930 has first opening 2932, second opening 2934, and third opening 2936; second column 2940 has first opening 2941, second opening 2942, third opening 2943, fourth opening 2944, fifth opening 2945, and sixth opening 2946; and fourth column 2960 has first opening 2962, second opening 2964, and third opening 2966. The openings of third column 2950, which are not shown, are symmetric to the openings of second column 2940.

Outer box 2900 may have any type of closure or sealing device. Outer box 2900 may have a flip-top lid that is attached to the outer box main body. or a lid that is not attached to the outer box main body and that is removable.

In some embodiments, outer box 2900 may also have a separation device that is configured to separate outer box 2900 into individual balls, sleeves and/or boxes. Outer box 2900 may also include perforations configured to separate into any number of sleeves and boxes.

In some embodiments, outer box 2900 may have walls on every side. In other embodiments, outer box 2900 may have open side walls.

The sleeves and outer boxes may be configured from blanks. Blanks may have the wall panels in any configuration. In one embodiment shown in FIG. 30, sleeve 300 may have been formed from blank 3000. Panels 3010, 3020, 3030, and 3040 are hingedly connected together along fold lines 3050, 3060, and 3070. Sleeve 300 may be formed by folding the panels. For example, panel 3010 may be folded at fold line 3050 while panel 3030 may be folded at fold line 3060 and panel 3040 may be folded at fold line 3070 so that panel 3040 converges with panel 3010. Panel 3010 may be attached to panel 3040 by a fastener. The fastener may be any known adhesive, like glue or tape, or mechanical means, such as staples.

Figure 31:
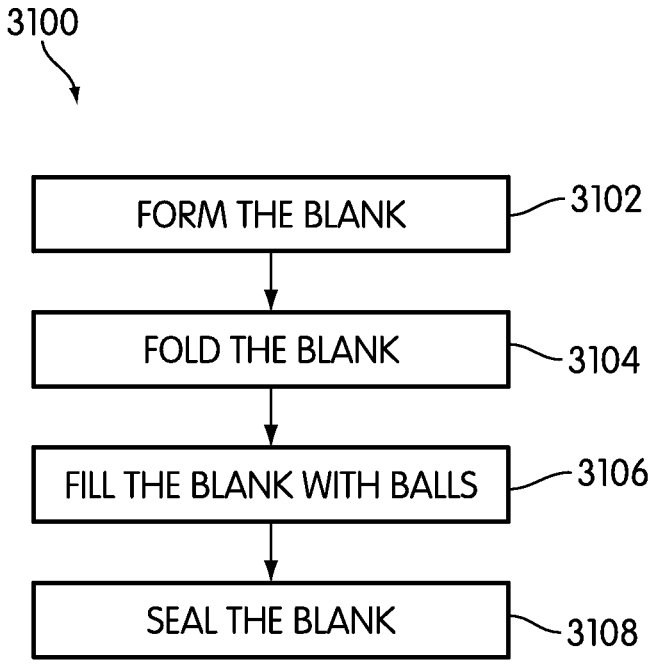
FIG. 31 is an embodiment of a process for forming a sleeve containing balls from a blank.

FIG. 31 illustrates a process for forming a sleeve containing golf balls from a blank. In step 3102, a blank from which the sleeve is configured may be formed. To form a sleeve according to any embodiment discussed above, a blank may be cut to a predetermined configuration. For example, for sleeve 300, the blank may be cut into the configuration shown in FIG. 30.

After the blank is formed, in step 3104, the blank may be folded along the fold lines. The blank may be folded along the fold lines so that it can be filled by golf balls. In some embodiments, the blank may not be folded along all of the fold lines. For example, for sleeve 300, panel 3030 may be folded at fold line 3060 and panel 3040 may be folded at fold line 3070 so that panel 3040 is parallel with panel 3020.

In step 3106, the blank may then be filled with the balls. The amount of balls depends on the configuration of the blank. In some embodiments, the blank may be filled with three golf balls. In other embodiments, the blank may be formed with twelve golf balls.

After the blank is filled with the balls, at step 3108, the blank may be sealed to form the sleeve. The blank may be edge-sealed with an adhesive, like glue or tape, or mechanical means, such as staples. In some embodiments, the blank may need to be further folded before the blank is sealed. For example, with respect to blank 3000, panel 3010 may be folded at fold line 3050 so that it converges with panel 3040. After which, blank 3000 may be sealed with an adhesive to form a sleeve.

The process may not include all of the steps discussed above. For example, it may be not necessary to form the blanks. The sleeves may be formed from preconfigured blanks. Also, the steps in the process discussed above may be performed in any order. The steps need not be performed in the order shown in the figure or in the order described above. The order of steps in the process may be altered in some embodiments.

Although not shown, the sleeves and outer boxes may include graphics that compel the retailer to provide a larger amount of shelf space for the outer box. For example, referring to FIG. 29, outer box 2900 may include graphics along the surfaces of columns 2930, 2940, and 2960 that requires the outer box to be displayed in the diamond position with column 2940 in the front and middle so that the graphic can be properly understood. This position would require shelf space that is almost equivalent to three golf balls. This would be larger than the known square inner box shown in FIG. 2 and thus would require more visible retail space.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A packaging for a ball, comprising:

a first inner packaging comprising:

a first wall having an inner surface and an outer surface opposite the inner surface;

a second wall opposing the first wall, the second wall having an inner surface and an outer surface opposite the inner surface, a space between the first wall and the second wall defining an inner void;

the first wall defining at least a first opening and the second wall defining at least a second opening; and a wall opening disposed between the first wall and the second wall;

wherein at least one of the first opening and the second opening is configured to expose a first portion of the ball and restrain movement of the ball, and the wall opening is configured to expose a second portion of the ball;

wherein the at least a portion of an edge of at least one of the first opening and the second opening is configured to restrain the ball by directly engaging with a surface of the ball; and wherein a portion of the ball protrudes through at least one of the first opening and the second opening and extends beyond the outer surface of at least one of the first wall and the second wall;

a second outer packaging, wherein the second outer packaging comprises a first outer wall and a second outer wall where the first outer wall or the second outer wall define at least four openings, wherein the four openings of either the first outer wall or the second outer wall are configured to expose a first portion of the ball of the first inner package and restrain movement of the ball;

wherein the second packaging is configured to receive the first inner packaging, the first inner packaging being configured to contain at least three balls.

2. The packaging according to claim 1, wherein at least one of the first opening and the second opening is round and has a diameter that is smaller than a diameter of the ball.

3. The packaging according to claim 1, wherein at least one of the first opening and the second opening has a length that is larger than a diameter of the ball.

4. The packaging according to claim 1, wherein the first wall and the second wall includes at least one angled corner.

5. The packaging according to claim 1, wherein the first wall and the second wall each include three circular openings, and wherein the openings of the first wall and the second wall are identical.

6. The packaging according to claim 1, wherein the first packaging is configured to contain three golf balls.

7. The packaging according to claim 1, wherein the first wall and the second wall each include four cylindrical openings, and wherein the openings of the first wall are substantially similar to the openings of the second wall.

8. The packaging according to claim 7, wherein the packaging is configured to contain twelve balls.

9. The packaging according to claim 7, the packaging further comprising:

a separation device configured to separate the packaging into packages of at least one ball.

10. The packaging according to claim 1, wherein the first wall and the second wall converge at a first seam at the top of the packaging and the first wall and the second wall converge at a second seam at the bottom of the packaging.

11. The packaging according to claim 1, wherein the four openings of the first wall or the second wall of the second packaging have a length that is larger than a diameter of the ball.

* * * * *